US009519255B2

(12) United States Patent
Sasaki et al.

(10) Patent No.: US 9,519,255 B2
(45) Date of Patent: Dec. 13, 2016

(54) LABEL PRINTER

(71) Applicant: Graphtec Corporation, Kanagawa (JP)

(72) Inventors: Shinichi Sasaki, Kanagawa (JP); Hiroshi Ohtsuka, Kanagawa (JP); Susumu Shoji, Hyogo (JP)

(73) Assignee: Graphtec Corporation, Kanagawa (JP)

( * ) Notice: Subject to any disclaimer, the term of this patent is extended or adjusted under 35 U.S.C. 154(b) by 0 days.

(21) Appl. No.: 14/744,865

(22) Filed: Jun. 19, 2015

(65) Prior Publication Data

US 2016/0161895 A1 Jun. 9, 2016

(30) Foreign Application Priority Data

Jun. 20, 2014 (JP) ..... 2014-127569

(51) Int. Cl.
*G03G 15/00* (2006.01)

(52) U.S. Cl.
CPC ..... *G03G 15/6582* (2013.01); *G03G 15/6517* (2013.01); *G03G 15/6529* (2013.01); *G03G 15/6588* (2013.01); *G03G 15/6591* (2013.01); *G03G 2215/00455* (2013.01); *G03G 2215/00472* (2013.01); *G03G 2215/00814* (2013.01)

(58) Field of Classification Search
CPC ..... G03G 15/657
USPC ..... 399/400
See application file for complete search history.

(56) References Cited

U.S. PATENT DOCUMENTS 7,182,334 B2 * 2/2007 Spence ..... B65H 29/242 271/197
7,424,246 B2 * 9/2008 Spence ..... G03G 15/2064 399/110
7,720,401 B2 * 5/2010 Domoto ..... G03G 15/657 399/322

(Continued)

FOREIGN PATENT DOCUMENTS

JP H06-278938 A 10/1994
JP 7098407 B2 10/1995

(Continued)

OTHER PUBLICATIONS

Extended European Search Report dated Dec. 2, 2015 for corresponding European Patent Application No. 15172548.8.

(Continued)

*Primary Examiner* — Anthony Nguyen
(74) *Attorney, Agent, or Firm* — Typha IP LLC

(57) ABSTRACT

The provided is an electrographic type label printer to properly supply a roll paper to the printer, having a transfer portion of a toner image, a fixing portion, an unwinder that feeds a roll paper, a rewinder that takes up the roll paper, a conveyance mechanism, and slack detection sensors that detect a slack degree of a medium between the transfer portion and the fixing portion. The conveyance mechanism has a conveyance belt to be rotated while mounting the medium on an upper surface facing the upper side, and an intake mechanism for tightly fitting the medium to the upper surface of the conveyance mechanism. When selecting a mode to convey the roll paper, a paper feed unit controller controls passing speed at which the medium passes through a pass-through portion provided in the fixing portion in accordance with output signals from the slack detection sensors.

8 Claims, 12 Drawing Sheets

(56) References Cited

U.S. PATENT DOCUMENTS

| | | | | |
|---|---|---|---|---|
| 8,219,019 | B2 * | 7/2012 | Yanagi | G03G 15/0131 399/302 |
| 8,626,051 | B2 * | 1/2014 | Kasuga | B65H 5/062 271/270 |
| 2004/0131406 | A1 * | 7/2004 | Ohki | G03G 15/6576 399/384 |
| 2007/0020001 | A1 * | 1/2007 | Tanabe | G03G 15/2064 399/322 |
| 2009/0003896 | A1 * | 1/2009 | Domoto | G03G 15/657 399/323 |
| 2010/0266305 | A1 | 10/2010 | Yanagi | |
| 2012/0243898 | A1 | 9/2012 | Yanagi | |
| 2012/0269531 | A1 * | 10/2012 | Suzuki | G03G 15/657 399/67 |
| 2013/0094873 | A1 * | 4/2013 | Flores | G03G 15/652 399/66 |
| 2014/0064747 | A1 | 3/2014 | Numazu | |

FOREIGN PATENT DOCUMENTS

| | | | |
|---|---|---|---|
| JP | 2002-338113 | A | 11/2002 |
| JP | 2003-122085 | A | 4/2003 |
| JP | 2007-063001 | A | 3/2007 |
| JP | 2010-198013 | A | 9/2010 |
| JP | 2014-052433 | A | 3/2014 |

OTHER PUBLICATIONS

Notification of Reason for Refusal dated Jul. 12, 2016 for corresponding Korean Patent Application No. 10-2015-0086382 with Machine Translation.

* cited by examiner

LABEL PRINTER

CROSS REFERENCE TO RELATED APPLICATIONS

This application is based upon and claims the benefit of priority from the prior Japanese Application No. JP 2014-127569, filed on Jun. 20, 2014, the enter content of which is incorporated herein by reference.

TECHNICAL FIELD

The present invention relates to an electrographic type label printer, and particularly relates to a label printer capable of transferring a toner image to a roll shaped medium and printing an image.

BACKGROUND ART

Label printers are generally used in a case where an image is printed to a continuous medium such as a roll paper (for example, refer to Patent Documents 1 to 3). In some label printers that print an image to a roll shaped medium, the image is printed to the medium by an electrographic method as in devices described in Patent Documents 1 and 2. The label printers described in Patent Documents 1 and 2 have toner image formation units that form an image (toner image) developed with toner, and an intermediate transfer body to which the toner image is primarily transferred, the intermediate transfer body to be rotated while holding the toner image.

Further, in the label printers described in Patent Documents 1 and 2, a pair of rollers that nips the medium to secondarily transfer the toner image held on the intermediate transfer body, and a pair of rollers that nips the medium to fix the transferred toner image are arranged at positions in the middle of a conveyance route for the medium formed in the device. It should be noted that the fixing roller may be abutted with the medium in a state where the roller is heated for fixing the toner image to the medium.

CITATION LIST

Patent Document

[Patent Document 1] Unexamined Japanese Patent Publication No. 2014-52433
[Patent Document 2] Unexamined Japanese Patent Publication No. 6-278938
[Patent Document 3] Unexamined Japanese Patent Publication No. 2002-338113

SUMMARY OF THE INVENTION

Problems to be Solved by the Invention

In a case where a condition relating to printing such as a type of a medium to be used is changed, an outer diameter of the fixing roller is sometimes accordingly changed. For example, in a case where a medium having larger thickness is used, a surface temperature of the fixing roller is increased in comparison to a case where a medium having smaller thickness is used. Naturally, the higher the surface temperature of the roller is, the more an increase amount when the outer diameter of the fixing roller is increased by thermal expansion heat is increased. As a result, in a case where the medium having larger thickness is used, circumferential speed of the fixing roller is increased in comparison to a case where the medium having smaller thickness is used.

Meanwhile, when a roll shaped medium is used as the medium, the roll shaped medium is extended between a feed roller and a take-up roller, and a toner image is secondarily transferred and fixed between the feed roller and the take-up roller. That is, parts of the roll shaped medium are nipped by a pair of transfer rollers after fed out and until taken up and further nipped by a pair of fixing rollers on the downstream side thereof. At this time, when circumferential speed of the fixing roller is changed in accordance with a change in a printing condition, slack is generated and extinguished between two parts of the roll shaped medium nipped by each pair of rollers.

When the above slack is excessively generated, a paper jam (so-called, the jam) is caused. On the contrary, when the medium is pulled by the fixing roller in a state where the above slack is extinguished, that is, in a state where the roll shaped medium is strained, there is a fear that transfer of the toner image performed on the upstream side thereof is troubled. Therefore, there is a need for stabilizing a degree of slack generated in the part of the roll shaped medium where the toner image is transferred or later. As described above, excess or shortage of the slack generated on the downstream side of the part of the roll shaped medium where the toner image is transferred generates failure such as the jam and transfer failure, and badly influences quality of an image to be printed at the end.

Meanwhile, Patent Document 2 describes that upon cutting a roll paper by designated length, slack is provided on the downstream side of a cut position, and the slack is managed to a proper amount. However, the technique described in Patent Document 2 is not to control the slack generated on the downstream side of the part of the roll shaped medium where the toner image is transferred, and hence not a technique for improving the quality of the printed image.

Patent Document 3 describes that slack is provided to a roll paper in order to eliminate pausing failure of the roll paper generated when a remaining amount of the roll paper wound around a feed roller is changed, and the slack is controlled to a proper amount. However, the technique described in Patent Document 3 is a technique relating to an ink jet type label printer, and after all, an amount of the slack is not controlled for the purpose of improving the transfer failure of the toner image or the like.

The present invention is achieved in consideration of the above problems, and an object thereof is to provide, as a label printer that prints an image to a roll shaped medium by an electrographic method, a label printer capable of properly supplying the roll shaped medium and improving the quality of the printed image.

As a specification that a label printer is required, the label printer is desired to deal with not only the roll shaped medium but also other media such as cut papers. Further, more preferably, the roll shaped medium is cut by predetermined length to create cut papers and an image can be printed to such cut papers. Another object of the present invention is to provide a label printer capable of dealing with any of a method of supplying a roll shaped medium as it is roll shaped, a method of supplying a single strip shaped medium, and a method of cutting the roll shaped medium and supplying as the single strip shaped medium as a method of supplying the medium.

Further, in a case where a medium where fragmentary adhesive media are attached to a continuous release paper as in a die cut label is used, and when the medium is remarkably bent in the middle of a conveyance route thereof, there is a fear that the adhesive media are detached. Another object of the present invention is to provide a label printer capable of, in a case where a medium including a release paper and adhesive media is used, suppressing the adhesive media from being detached while the medium is conveyed.

Means for Solving the Problems

The above problems are solved by a label printer of the present invention, the electrographic type label printer, including a printer unit that transfers a toner image to a medium and prints an image to the medium, a medium supply unit that supplies the medium to the printer unit, a first control unit that controls the medium supply unit, and a second control unit that controls the printer unit, characterized in that (A) the printer unit has (a1) a transfer portion that transfers the toner image to the medium, and (a2) a fixing portion that fixes the toner image transferred to the medium, (B) the medium supply unit has (b1) a feed roller that feeds a roll shaped first medium serving as the medium, (b2) a take-up roller that takes up apart of the first medium where the image is printed, (b3) a cutter arranged between the feed roller and the take-up roller, the cutter that cuts the first medium, (b4) a supplying mechanism that supplies a single strip shaped second medium serving as the medium while retaining the second medium, (b5) a conveyance mechanism that conveys the medium in the printer unit, the conveyance mechanism being placed on the downstream side of the transfer portion in the conveying direction of the medium and on the upstream side of the fixing portion, and (b6) a detector that detects a slack degree of the medium between the transfer portion and the fixing portion in the conveying direction, and outputs a signal in accordance with the slack degree, (C) the conveyance mechanism has (c1) a conveyance mechanism main body that conveys the medium by moving a mount surface for the medium in a state where the mount surface faces the upper side, and (c2) an intake mechanism that performs an air intake action for tightly fitting the medium to the mount surface, (D) the first control unit is capable of selecting a conveyance mode of the medium by the conveyance mechanism from a first mode to convey the first medium extended between the feed roller and the take-up roller, a second mode to convey the second medium supplied from the supplying mechanism, and a third mode to convey the second medium created by cutting the first medium which is fed from the feed roller by the cutter, (E) passing speed at which the medium passes through a pass-through portion provided in the fixing portion is variable, and (F) when the first control unit selects the first mode, the second control unit controls the passing speed in accordance with an output signal from the detector in order to adjust the slack degree within a preliminarily set range.

With the label printer of the present invention formed as above, when the image is printed to the roll shaped first medium, the slack degree of the medium between the transfer portion and the fixing portion is detected, and the passing speed of the medium in the fixing portion is adjusted in accordance with a detection result. Thereby, even when a printing condition such as a type of the medium is changed, the above slack degree can be adjusted to be a proper amount. As a result, failure generated due to excess or shortage of the slack (such as a jam and transfer failure) is avoided, so that quality of a printed image can be improved. Further, with the label printer of the present invention, the conveyance mode is selected from the mode to convey the roll shaped medium as it is roll shaped, the mode to convey the single strip shaped medium, and the mode to cut the roll shaped medium and convey as the single strip shaped medium. Thereby, variations of a method of supplying the medium are increased, and a highly versatile label printer can be provided.

Favorably, in the above label printer, the mount surface is inclined in such a manner that a downstream side end in the conveying direction is placed on the upper side of an upstream side end, an upstream side end portion in the conveying direction of the mount surface is placed on the lower side of a pass-through portion for the medium provided in the transfer portion, and a downstream side end portion in the conveying direction of the mount surface extends toward the pass-through portion provided in the fixing portion.

With the above configuration, in the mount surface of the conveyance mechanism, the upstream side end portion in the conveying direction is placed on the lower side of the pass-through portion for the medium provided in the transfer portion. Thereby, the slack is generated between a part of the roll shaped medium where the toner image is transferred and a part mounted on the mount surface at an upstream side end in the conveying direction. Meanwhile, in the mount surface, the downstream side end portion in the conveying direction extends toward the pass-through portion for the medium provided in the fixing portion. Thereby, in a case where the single strip shaped medium is used, a downstream side end portion in the conveying direction of the medium smoothly enters the fixing portion after being separated from the mount surface. Thus, generation of the jam at such a position can be suppressed.

More favorably, in the above label printer, the second control unit controls to maintain passing speed at which the medium passes through the pass-through portion provided in the transfer portion at fixed speed while the printer unit prints the image to the medium.

With the above configuration, effects of the present invention become more meaningful. Specifically speaking, during image printing, the passing speed at which the medium passes through the pass-through portion provided in the transfer portion, in other words, speed at which the toner image is transferred to the medium (transfer speed) is maintained at fixed speed. In contrast, speed at which the medium passes through the pass-through portion provided in the fixing portion is changed for example depending on a change in an outer diameter of fixing rollers or the like. At this time, when the passing speed at which the medium passes through the pass-through portion provided in the fixing portion is excessively increased, the slack degree of the medium is reduced. If the slack is completely extinguished, the medium is pulled to the side of the fixing portion and strained. As a result, there is a possibility that the toner image is not properly transferred on the upstream side. Meanwhile, with the label printer of the present invention, a change in the slack degree is detected by the detector, and the passing speed at which the medium passes through the pass-through portion provided in the fixing portion is adjusted in accordance with the detection result. Thus, the above slack degree can be fixed and maintained. That is, on the upstream side of a part of the roll shaped medium where the slack is generated, feeding speed of the medium is fixed for transferring the toner image. Thus, by changing the feeding speed of the medium on the downstream side of the part where the slack is generated, the slack degree can be properly adjusted.

Much more favorably, in the above label printer, the printer unit has a plurality of toner image formation units that forms the toner images of color different from each other, and an endless intermediate transfer belt to which the toner images of different colors formed by the plurality of toner image formation units are successively transferred, the intermediate transfer belt to be rotated while holding a color toner image formed by superimposing the toner images of different colors on each other, the plurality of toner image formation units is arranged side by side in the up and down direction, and the color toner image is transferred to the medium when a part of the intermediate transfer belt where the color toner image is held passes through the pass-through portion provided in the transfer portion together with the medium.

With the above configuration, the color toner image is collectively transferred at one point in the conveyance route for the medium. Thus, in comparison to a configuration that toner images of different colors are individually transferred at plural points in a conveyance route for a medium, the slack is easily provided to the medium (strictly speaking, a space where the slack is provided is easily ensured). Further, in a case where a medium including a continuous release paper and fragmentary adhesive media attached to the release paper is used, the smaller number of points where the toner image is transferred are, the less likely the adhesive media are detached.

Furthermore favorably, in the above label printer, the plurality of detectors is provided at positions different from each other in the conveying direction, one of the detectors detects the slack degree of the medium on the side closer to the transfer portion among the transfer portion and the fixing portion, and the other detector detects the slack degree of the medium on the side closer to the fixing portion among the transfer portion and the fixing portion.

With the above configuration, the slack degree of the medium is detected respectively on the side closer to the transfer portion and on the side closer to the fixing portion. Thus, excess or shortage of the slack degree can be properly grasped.

Further favorably, in the above label printer, each of the plurality of detectors includes a lever that stands up and falls down in accordance with the slack degree and outputs a signal indicating a standing/falling state of the lever as a signal in accordance with the slack degree, when the medium is extended without any slack, the detector that detects the slack degree of the medium on the side closer to the transfer portion outputs an OFF signal indicating that the lever is in a standing state, and the detector that detects the slack degree of the medium on the side closer to the fixing portion outputs an ON signal indicating that the lever is in a falling state, and when receiving the OFF signal from the detector that detects the slack degree of the medium on the side closer to the transfer portion and receiving the ON signal from the detector that detects the slack degree of the medium on the side closer to the fixing portion, the second control unit decreases the passing speed at which the medium passes through the pass-through portion provided in the fixing portion.

With the above configuration, the ON and OFF signals are received from the detectors, and in accordance with a receiving pattern thereof (whether the ON signal or the OFF signal is received from each of the detectors), the passing speed at which the medium passes through the pass-through portion provided in the fixing portion is controlled. Particularly when the slack degree of the medium between the transfer portion and the fixing portion becomes excessively small, the passing speed at which the medium passes through the pass-through portion provided in the fixing portion can be decreased and the slack degree can be adjusted to be a normal slack degree.

All the more favorably, in the above label printer, when excessive slack is generated in the medium, the detector that detects the slack degree of the medium on the side closer to the transfer portion outputs an ON signal indicating that the lever is in a falling state, and the detector that detects the slack degree of the medium on the side closer to the fixing portion outputs an OFF signal indicating that the lever is in a standing state, and when receiving the ON signal from the detector that detects the slack degree of the medium on the side closer to the transfer portion and receiving the OFF signal from the detector that detects the slack degree of the medium on the side closer to the fixing portion, the second control unit increases the passing speed at which the medium passes through the pass-through portion provided in the fixing portion.

With the above configuration, when the slack degree of the medium between the transfer portion and the fixing portion becomes excessively large, the passing speed at which the medium passes through the pass-through portion provided in the fixing portion can be increased and the slack degree can be adjusted to be a normal slack degree. As a result, with the above configuration, the slack degree of the medium between the transfer portion and the fixing portion can be adjusted without excess or shortage.

In the above label printer, the supplying mechanism may have a tray on which the second medium is mounted, and successively take out the second medium on the tray from an end of the tray on the side close to the printer unit and deliver the second medium toward an interior of the printer unit, and an end of the tray placed on the opposite side of the printer unit may be placed at the same position as or on the upper side of the end of the tray on the side close to the printer unit in the up and down direction.

Further favorably, in the above label printer, length along the conveying direction of the second medium created by cutting the first medium by the cutter in the third mode may be variable, and when the length along the conveying direction of the second medium created upon selecting the third mode by the first control unit is not less than a distance between the pass-through portion for the medium provided in the transfer portion and the pass-through portion for the medium provided in the fixing portion, the second control unit controls passing speed at which the second medium passes through the pass-through portion provided in the fixing portion in accordance with the output signal from the detector in order to adjust the slack degree within a preliminarily set range.

With the above configuration, as well as the roll shaped medium, even in a case where the image is printed to the relatively long second medium, the slack degree of the medium between the transfer portion and the fixing portion is also detected and the passing speed of the medium in the fixing portion is adjusted in accordance with the detection result. That is, with the above configuration, in a case where the image is printed to the relatively long second medium under execution of the third mode, the slack degree is adjusted to be a proper amount and failure generated due to excess or shortage of the slack is avoided, so that the quality of the printed image can be improved.

Effects of the Invention

With the label printer of the present invention, when the image is printed to the roll shaped medium, the slack can be provided without excess or shortage on the downstream side of the part of the above medium where the toner image is transferred irrespective of a type of the medium. Thereby, the failure such as the jam and the transfer failure generated due to excess or shortage of the slack can be avoided, so that the quality of the printed image can be improved.

With the label printer of the present invention, the conveyance mode is selected from the mode to convey the roll shaped medium as it is roll shaped, the mode to convey the single strip shaped medium, and the mode to cut the roll shaped medium and convey as the single strip shaped medium. Thus, variations of the method of supplying the medium are increased.

Further, with the label printer of the present invention, in a case where the medium including the continuous release paper and the fragmentary adhesive media attached to the release paper is used, the adhesive media are less likely to be detached.

BRIEF DESCRIPTION OF THE DRAWINGS

FIG. 4 A view showing an example of a medium (first medium) to be used in the label printer according to the embodiment of the present invention.

MODE FOR CARRYING OUT THE INVENTION

Figure 2:
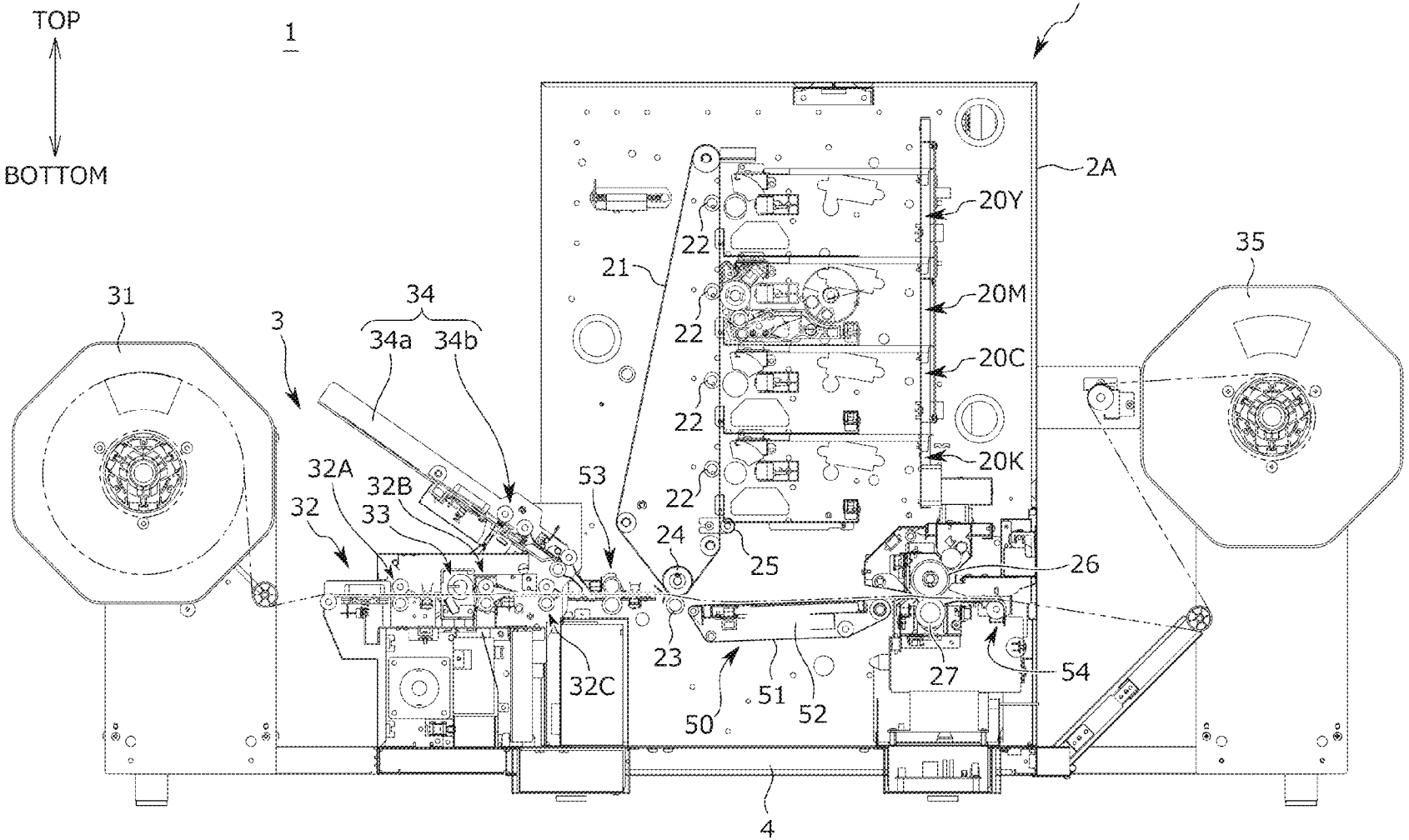
FIG. 2 A view showing an internal configuration of the label printer according to the embodiment of the present invention.
Figure 3:
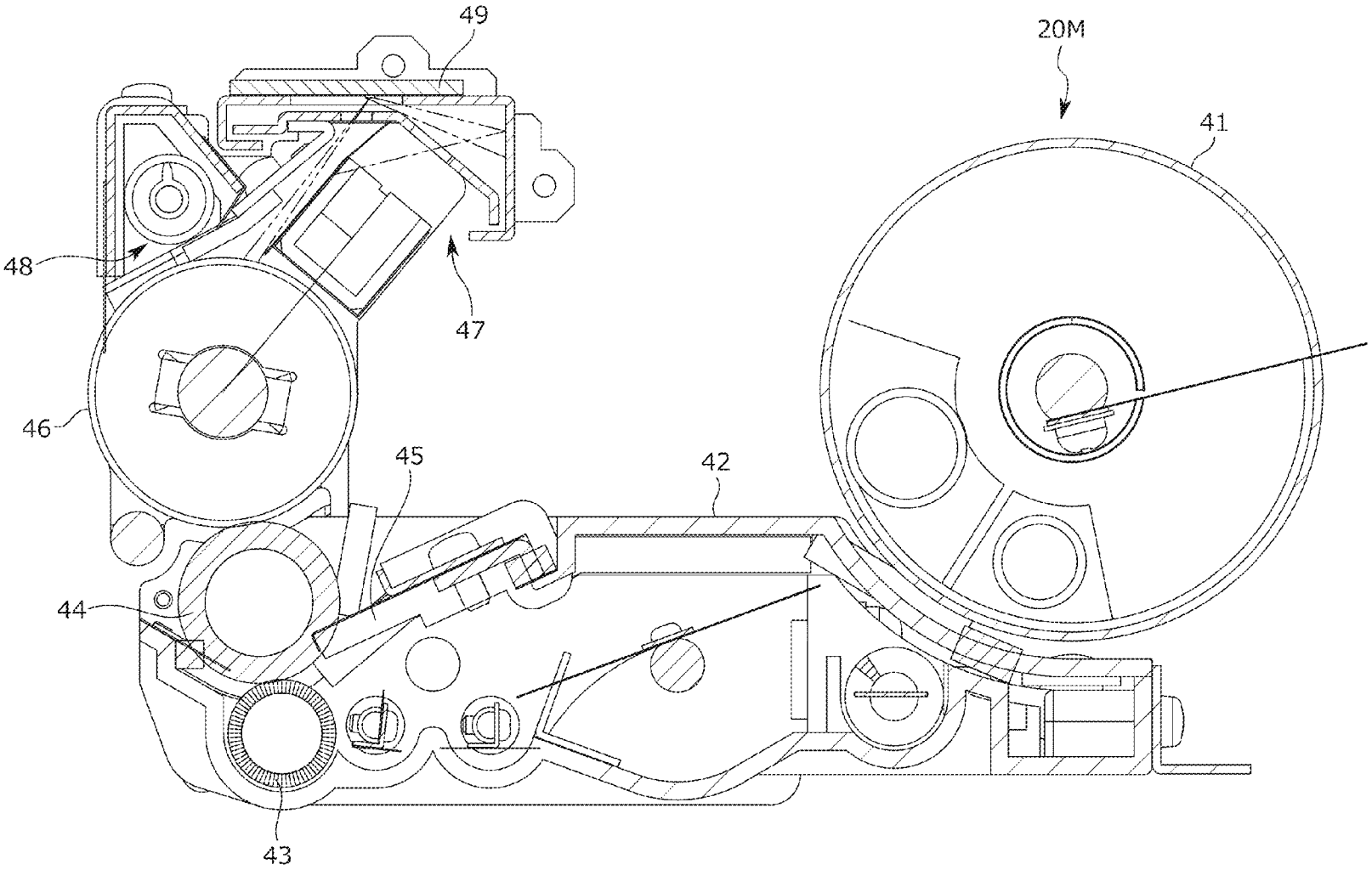
FIG. 3 A view showing a configuration of a toner image formation unit.

Basic Configuration of Label Printer According to One Embodiment of the Present Invention Hereinafter, an overview of a basic configuration of a label printer according to one embodiment of the present invention (present embodiment) will be described with reference to FIGS. 1 to 3. In the figures, the vertical direction is indicated by arrows. In FIG. 2, a conveyance route for a medium is indicated by a double chain line. It should be noted that in FIG. 2, among toner image formation units 20Y, 20M, 20C, 20K, the units other than the toner image formation unit 20M for magenta are slightly simplified in the figure.

The label printer according to the present embodiment (hereinafter, referred to as the printer 1) is a label printer that prints an image, strictly speaking, a color image of four colors of YMCK to a medium by an electrographic method. In the present embodiment, the medium indicates a label paper formed by a release paper and adhesive media. However, the medium is not particularly limited to the label paper but any medium to which the image can be printed by the electrographic method such as a normal paper (thin paper), a film, an OHP sheet, or a cardboard can be utilized without any restriction. In the following description, the phrase "single strip" indicates a state where the medium is cut to form a single sheet, and includes form paper size set by a standard or the like as a matter of course. On the other hand, arbitrary size may be included as long as the medium is cut and separated.

Figure 1:
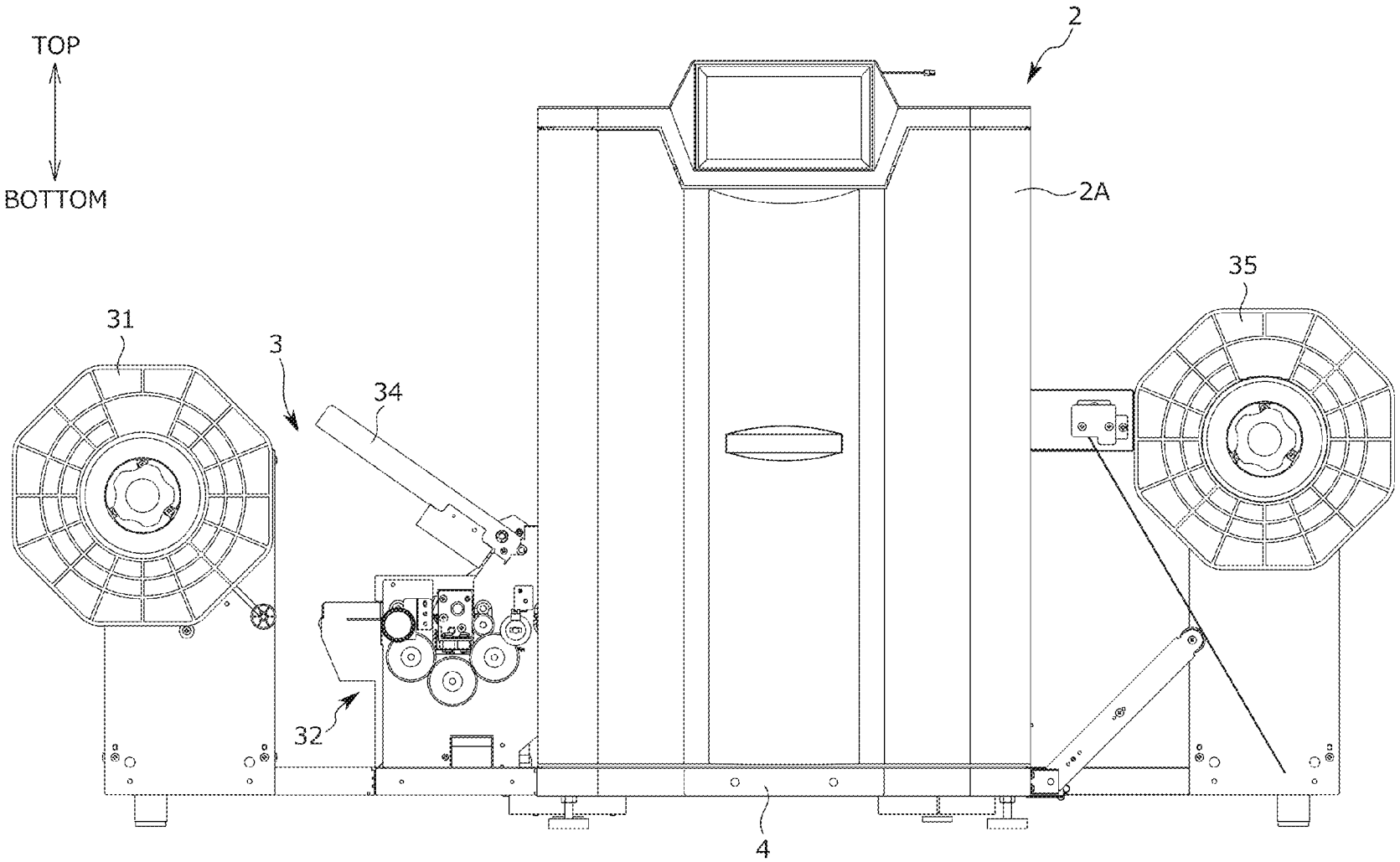
FIG. 1 An outer appearance view of a label printer according to one embodiment of the present invention.

The printer 1 has an outer appearance shown in FIG. 1, and has a printer unit 2 and a paper feed unit 3. These units 2, 3 are detachably assembled to a base 4. As shown in FIG. 1, the units are arranged in a state where the printer unit 2 is sandwiched between a paper loading mechanism and a paper ejection mechanism of the paper feed unit 3.

The printer unit 2 corresponds to a printer unit, and transfers a color toner image of four colors of YMCK to the medium and prints a color image to the medium. A basic configuration of the printer unit 2 is the substantially same configuration as a general electrographic type printer (that is, a laser printer). Specifically speaking, the printer unit 2 has an endless intermediate transfer belt 21, and the toner image formation units 20Y, 20M, 20C, 20K, primary transfer rollers 22, a secondary transfer roller 23, an opposing roller 24, and a belt cleaner 25 are arranged along the circumferential direction of the intermediate transfer belt 21. A pair of fixing rollers 26, 27 is arranged in the vicinity of a paper ejection port of the printer unit 2.

The toner image formation units 20Y, 20M, 20C, 20K are provided for different colors. A configuration of each of the toner image formation units will be described. As shown in FIG. 3, a toner of each color supplied from a toner cartridge 41 is housed in a housing 42. In the housing 42, a supply roller 43 made of a sponge or the like is abutted with an outer peripheral surface of a developing roller 44 while holding the toner on an outer peripheral surface thereof. Thereby, the toner is attached to the outer peripheral surface of the developing roller 44 and a toner layer is formed. It should be noted that thickness of the above toner layer is regulated to be fixed thickness by abutting a regulation blade 45 with the outer peripheral surface of the developing roller 44 in a rotated state.

A photosensitive drum 46 is arranged at a position opposing to an opening formed in the housing 42. In a state where the photosensitive drum 46 is electrified by an electrifier 47, an exposure device (not shown) irradiates a laser beam onto an outer peripheral surface of the photosensitive drum 46. Thereby, a latent image is formed on the outer peripheral surface of the photosensitive drum 46. Meanwhile, the outer peripheral surface of the developing roller 44 faces the opening formed in the housing 42, and opposes to the outer peripheral surface of the photosensitive drum 46. The toner forming the layer on the outer peripheral surface of the developing roller 44 is moved toward the outer peripheral surface of the photosensitive drum 46 as an electric field is formed between the developing roller 44 and the photosensitive drum 46 by a fixed developing bias voltage applied to the developing roller 44. As a result, the latent image formed on the photosensitive drum 46 is developed by the toner, and a toner image is formed on the outer peripheral surface of the photosensitive drum 46.

The above toner image is transferred to the intermediate transfer belt 21 at a position where the intermediate transfer belt 21 is nipped between the photosensitive drum 46 and the primary transfer roller 22 (primary transfer position). It should be noted that after the toner image is transferred from the photosensitive drum 46 to the intermediate transfer belt 21, the remaining toner is wiped off the photosensitive drum 46 by a photosensitive drum cleaner 48, and further, the electricity is removed by an electric remover 49, so that the photosensitive drum is ready for next latent image formation.

By successively performing the above processing for each of the toner image formation units 20Y, 20M, 20C, 20K of different colors, the toner images of different colors of YMCK are superimposed on each other and transferred to the intermediate transfer belt 21. The intermediate transfer belt 21 forms a transfer portion together with the primary transfer rollers 22, the secondary transfer roller 23, and the opposing roller 24, and is rotated in a state where an outer surface thereof holds the color toner image.

When the color toner image reaches a secondary transfer position by rotation of the intermediate transfer belt 21, the color toner image is transferred to the medium passing through the secondary transfer position at the timing. The secondary transfer position is a position nipped between the secondary transfer roller 23 and the opposing roller 24, the rollers being placed up and down. A space corresponding to the secondary transfer position, that is, a nipping part formed between the secondary transfer roller 23 and the opposing roller 24 (part where the medium is nipped between the rollers) corresponds to a pass-through portion (a second pass-through portion 82) provided in the transfer portion.

Secondary transfer will be described. In the present embodiment, when the medium passes through the secondary transfer position, the color toner image is transferred from the intermediate transfer belt 21 to the medium by an electric field formed between the secondary transfer roller 23 and the opposing roller 24. It should be noted that when a part of the intermediate transfer belt 21 passing through the secondary transfer position then reaches a position to be abutted with the belt cleaner 25, the remaining toner attached to a surface is scraped off, so that the part is ready for next transfer (secondary transfer).

The medium to which the color toner image is transferred is moved toward a part between the pair of fixing rollers 26, 27 placed up and down, and is nipped by the fixing rollers 26, 27 at the time of passing through the part between the fixing rollers 26, 27. The fixing roller 26 on one side (hereinafter, referred to as the heat roller 26) is abutted with the medium in a heated state where an outer peripheral surface thereof has a predetermined temperature (high temperature). Therefore, since the medium is nipped by the fixing rollers 26, 27, the color toner image transferred to the medium is heated and pressurized to be fused to the medium.

As described above, in the present embodiment, the pair of fixing rollers 26, 27 placed up and down forms a fixing portion. In other words, a position nipped between the fixing rollers 26, 27 corresponds to a fixing position. A space corresponding to the fixing position, that is, a nipping part formed between the fixing rollers 26, 27 (part where the medium is nipped between the rollers) corresponds to a pass-through portion (a first pass-through portion 81) provided in the fixing portion.

The medium to which the color toner image is fused, that is, the medium to which the color image is printed is finally ejected out of the unit through an ejection port formed in a casing 2A of the printer unit 2.

In the present embodiment, as shown in FIG. 2, the intermediate transfer belt 21 is arranged to spread along the up and down direction. The toner image formation units 20Y, 20M, 20C, 20K of different colors are arranged side by side in the up and down direction, and specifically, arranged along a part of the intermediate transfer belt 21 extending in the up and down direction.

In the present embodiment, the secondary transfer position is set to be a position where a lower end portion of the intermediate transfer belt 21 passes through. Specifically speaking, the secondary transfer roller 23 is placed on the outer side of the lower end portion of the intermediate transfer belt 21, and abutted with the lower end portion from the lower side. The opposing roller 24 is placed on the opposite side of the secondary transfer roller 23 with respect to the lower end portion of the intermediate transfer belt 21, that is, on the inner side of the lower end portion of the intermediate transfer belt 21, and abutted with the lower end portion from the upper side.

Further, in the present embodiment, while the printer unit 2 prints the image, the intermediate transfer belt 21, the primary transfer rollers 22, the secondary transfer roller 23, and the opposing roller 24 are rotated always at fixed speed (circumferential speed) in synchronization with each other. That is, passing speed at which the medium passes through the secondary transfer position (corresponding to passing speed at which the medium passes through a pass-through portion provided in the transfer portion) is controlled to be fixed during image printing.

In contrast, rotation speed of one of the pair of fixing rollers 26, 27, specifically, the heat roller 26 to be heated is variable. Thereby, passing speed at which the medium passes through the fixing position (corresponding to the passing speed at which the medium passes through the pass-through portion provided in the fixing portion) is adjustable, and increased and decreased according to need.

It should be noted that in the present embodiment, the heat roller 26 is a drive roller, and the fixing roller 27 on the other side (hereinafter, referred to as the backup roller 27) is a driven roller that follows rotation of the heat roller 26. However, the present invention is not limited to this but the backup roller 27 may also be a drive roller. In such a case, rotation speed is desirably variable as well as the heat roller 26.

In the present embodiment, the secondary transfer roller 23 and the opposing roller 24 are driven rollers that are driven by drive of the intermediate transfer belt 21. However, the present invention is not limited to this but one of the two rollers (such as the secondary transfer roller 23) may be independently rotated and the other roller (such as the opposing roller 24) may be rotated to follow this.

Next, a configuration of the paper feed unit 3 will be described with reference to FIG. 2.

The paper feed unit 3 has the mechanism on the paper loading side and the mechanism on the paper ejection side. The former includes an unwinder 31, a roll feeder 32, a cutter unit 33, and a cut paper feeder 34. The latter includes a rewinder 35.

The unwinder 31 corresponds to a feed roller, and feeds a roll shaped label paper (corresponding to a first medium). The label paper fed from the unwinder 31 is appropriately hanged over a tension roller and guided into the roll feeder 32. This roll feeder 32 horizontally conveys the label paper and is formed by plural pairs of conveyance rollers 32A, 32B, 32C. It should be noted that horizontal conveyance indicates that the label paper is conveyed in such a manner that a surface of the label paper becomes a horizontal surface (strictly speaking, surfaces of the adhesive media attached to the release paper of the label paper face the upper side).

The cutter unit 33 corresponds to a cutter, and is provided in the conveyance route when the roll feeder 32 horizontally conveys the roll shaped label paper, and cuts the label paper. The cut label paper is charged into the printer unit 2 as single strips (corresponding to a second medium). In the printer unit 2, by the same procedure as a case of normal cut papers, the image is printed to the single strip shaped label papers.

It should be noted that the cutter unit 33 according to the present embodiment is a rotary cutter, and cuts the label paper by nipping the label paper with a pair of rollers having cutting blades. However, the cutter unit 33 is not limited to the rotary cutter but may be a guillotine cutter.

The rewinder 35 corresponds to a take-up roller, and takes up the label paper in a continuous state.

The cut paper feeder 34 corresponds to a supplying mechanism, and continuously supplies (loads) the cut papers serving as a single strip shaped medium (corresponding to the second medium). Specifically speaking, as shown in FIG. 2, the cut paper feeder 34 has a tray 34*a* that retains the cut papers serving as the single strip shaped medium (corresponding to the second medium), and a delivery roller 34*b* including a rotation roller. The tray 34*a* is arranged in a state that one longitudinal end thereof faces the printer unit 2 (specifically, a paper loading port of the printer unit 2). The cut papers are piled in a layer form and mounted on the tray 34*a*.

By bringing the delivery roller 34*b* in a rotated state into sliding contact with the uppermost cut paper among the cut papers piled on the tray 34*a*, the uppermost cut paper is taken out and delivered toward an interior of the printer unit 2 from the one longitudinal end of the tray 34*a*. The cut papers coming into the printer unit 2 are moved toward the position nipped between the secondary transfer roller 23 and the opposing roller 24, that is, the secondary transfer position in the unit. By successively performing the above actions, the cut papers on the tray 34*a* are successively supplied from the one longitudinal end of the tray 34*a*, and each of the cut papers is moved toward the secondary transfer position in the printer unit 2.

It should be noted that in the present embodiment, the cut paper feeder 34 is arranged on the upper side of the roll feeder 32 in the up and down direction, and the tray 34*a* is arranged in a state where the tray is inclined with respect to the horizontal direction. More specifically speaking, in the present embodiment, the tray 34*a* is arranged in such a manner that the other longitudinal end (corresponding to an end placed on the opposite side of the printer unit 2) is placed on the upper side of the one longitudinal end. By arranging the tray 34*a* in such a way, the direction in which the cut papers are supplied from the tray 34*a* (paper loading direction) is inclined by a predetermined inclination angle with respect to the conveying direction of the roll paper by the roll feeder 32 (that is, the horizontal direction).

In the present embodiment, as described above, the cut paper feeder 34 is arranged on the upper side of the roll feeder 32 in the up and down direction, and further, the tray 34*a* is provided in a state where the tray is inclined with respect to the horizontal direction. In a general label printer, a mechanism corresponding to the cut paper feeder 34 is often arranged in a lower portion of the printer. Thus, cut papers are moved from the lower side to the upper side in the printer. In contrast, in the present embodiment, with the above configuration, the cut papers smoothly come into the printer unit 2, and is moved in the substantially horizontal direction in the unit after coming into the unit. Thereby, the cut papers are smoothly supplied and conveyed. As a result, a series of processing relating to creation of printed matter is quickly performed.

It should be noted that arrangement of the tray 34*a* is not limited to the arrangement where the paper loading direction is inclined with respect to the horizontal direction. The tray may be arranged in such a manner that the paper loading direction is along the horizontal direction, in other words, the one longitudinal end of the tray 34*a* and the other longitudinal end are placed at the same position in the up and down direction.

Further, the paper feed unit 3 includes a mechanism that conveys the medium along the conveyance route in the printer unit 2. Such a mechanism will be described. The paper feed unit 3 includes a pair of paper loading rollers 53, a conveyance mechanism 50, and a pair of paper ejection rollers 54 from the upstream side in the conveying direction. The pair of paper loading rollers 53 conveys the medium toward the position nipped between the secondary transfer roller 23 and the opposing roller 24, that is, the secondary transfer position by being rotated while nipping the medium which comes into the printer unit 2.

The conveyance mechanism 50 is placed on the downstream side of the secondary transfer position in the conveying direction and arranged at the position nipped between the fixing rollers 26, 27, that is, the fixing position. In the present embodiment, as shown in FIG. 2, the conveyance mechanism 50 has an endless conveyance belt 51, and an intake mechanism 52 installed in the conveyance belt 51.

The conveyance belt 51 corresponds to a conveyance mechanism main body, and is made of a mesh shaped band body and arranged to spread along the horizontal direction. An upper surface of the conveyance belt 51 serves as a mount surface 55 for the medium. By being rotated in a state where the upper surface thereof faces the upper side, the conveyance belt 51 horizontally conveys the medium mounted on the mount surface toward the fixing position. The intake mechanism 52 reduces the atmospheric pressure in an internal space of the conveyance belt 51. An air intake action of this intake mechanism 52, the medium is tightly fitted to the mesh shaped mount surface.

With the conveyance mechanism 50 of the above configuration, the mechanism passing through the secondary transfer position (part of the medium) is mounted on the mount surface serving as the upper surface of the conveyance belt 51 and tightly fitted to the mount surface. After that, the medium is moved to the downstream side in the conveying direction following rotation of the conveyance belt 51. Apart of the medium reaching a downstream side end portion in the conveying direction of the conveyance belt 51 is brought toward the fixing position, that is, the part between the pair of fixing rollers 26, 27 (strictly speaking, the nipping portion between the rollers), and then passes through the fixing position. It should be noted that in the present embodiment, the nipping portion formed between the secondary transfer roller 23 and the opposing roller 24 serving as the secondary transfer position is placed at the substantially same position as the nipping portion formed between the pair of fixing rollers 26, 27 in the up and down direction.

The pair of paper ejection rollers 54 ejects the medium out of the unit through the ejection port formed in the casing 2A of the printer unit 2 by being rotated while nipping the medium which passes through the fixing position.

Since the pair of paper loading rollers 53, the conveyance mechanism 50, and the pair of paper ejection rollers 54 described above are provided, various media are horizontally conveyed over the substantially entire period from a time point when the media come into the printer unit 2 to a time point when the media are ejected out of the unit. By horizontally conveying the medium in the printer unit 2 in such a way, the medium is more smoothly supplied and conveyed in the present embodiment. As a result, the series of processing relating to the creation of the printed matter is quickly performed. Since the conveyance route for the medium does not meander up and down in the printer unit 2, detachment of the adhesive media to be possibly generated at the time of meandering of the medium in the up and down direction can also be avoided.

Figure 4A:
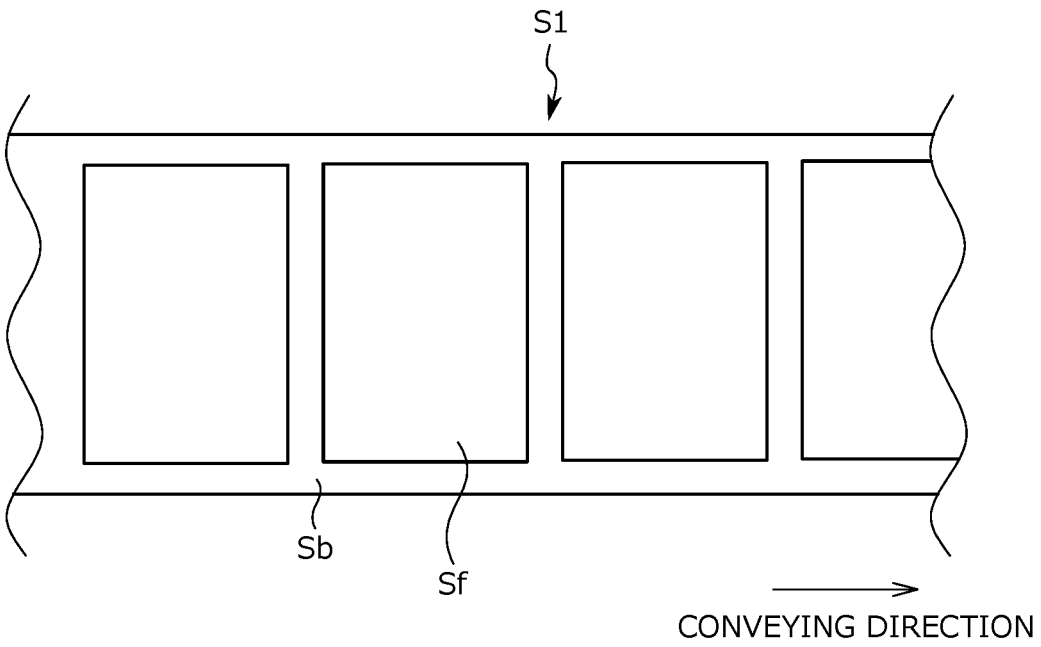
FIG. 4(A) is a plan view of the medium.
Figure 4B:
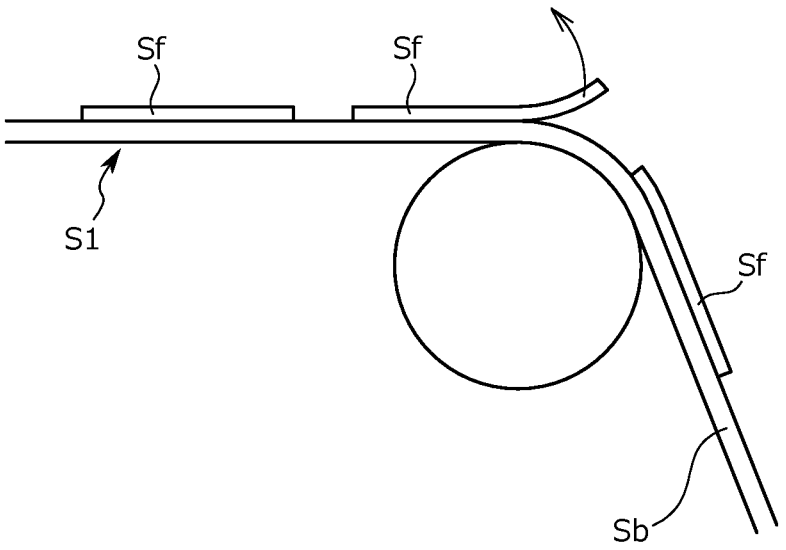
FIG. 4(B) shows a state where an adhesive medium is detached.

More specifically speaking, for example, a label paper as in FIG. 4(A), that is, a die cut label S1 is considered to be used as the medium. The die cut label S1 has a continuous release paper Sb, and fragmentary adhesive media Sf attached onto the release paper Sb at fixed intervals. As shown in FIG. 4(B), this die cut label S1 may be remarkably bent at the time of passing through a point where the conveying direction is switched (for example, a point where the conveying direction is switched from the horizontal direction to the vertical direction by a tension roller or the like). In such a case, there is a fear that an end portion of the adhesive medium Sf (downstream side end portion in the conveying direction) is detached from the release paper Sb as shown in the figure.

In contrast, in the present embodiment, the conveyance route in the printer unit 2 substantially horizontally extends over the entire interval. Thus, even the above die cut label S1 can be conveyed without generation of remarkable bending. That is, in the present embodiment, in a case where the die cut label S1 is used as the medium, the die cut label S1 can be properly conveyed while suppressing detachment of the adhesive media Sf.

<<Control System of Label Printer According to the Present Embodiment>>

Figure 5:
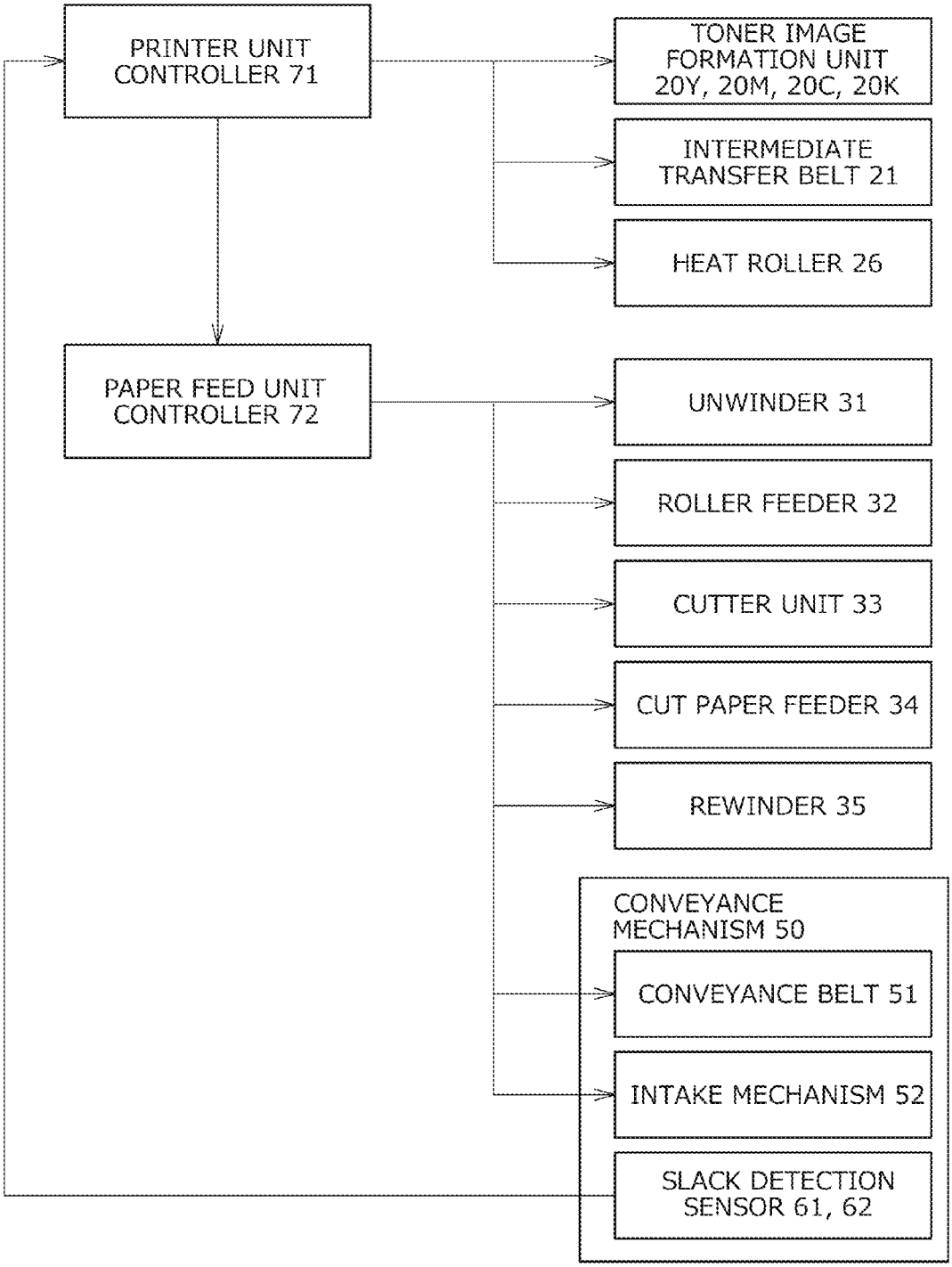
FIG. 5 A view showing a control system of the label printer according to the embodiment of the present invention.

Next, a control system of the printer 1 will be described with reference to FIG. 5. As shown in FIG. 5, the printer 1 includes a printer unit controller 71 that controls the printer unit 2, and a paper feed unit controller 72 that controls the paper feed unit 3. The paper feed unit controller 72 corresponds to a first control unit, and the printer unit controller 71 corresponds to a second control unit.

It should be noted that the following description is based on the assumption that the roll shaped label paper (first medium) fed from the unwinder 31 is the die cut label S1 described above. However, the die cut label S1 is only one example of the roll shaped label paper, and the present invention can also be applied to a case where other roll shaped label papers are used.

The printer unit controller 71 controls the portions of the printer unit 2. Specifically speaking, when receiving image printing data from a host computer (not shown), the printer unit controller 71 drives the toner image formation units 20Y, 20M, 20C, 20K to form toner images of different colors in accordance with a command based on the above image printing data.

The printer unit controller 71 rotates the intermediate transfer belt 21, the primary transfer rollers 22, the secondary transfer roller 23, and the opposing roller 24, and executes formation of the color toner image and transfer to the medium. At this time, the printer unit controller 71 brings the intermediate transfer belt 21, the primary transfer rollers 22, the secondary transfer roller 23, and the opposing roller 24 into synchronization with each other, and controls rotation speed to fixed circumferential speed. Thereby, while the image is printed to the medium in the printer unit 2, the passing speed at which the medium passes through the secondary transfer position is always maintained at fixed speed.

Further, the printer unit controller 71 starts a temperature increase of the heat roller 26 among the fixing rollers 26, 27, and rotates the heat roller 26 at a time point when a predetermined time elapses after the start of the temperature increase. Accordingly, the backup roller 27 is driven and rotated. Thereby, fixing of a printed image to the medium is executed.

It should be noted that in the present embodiment, the rotation speed of the heat roller 26 is variable as described above. While the image is printed to the medium in the printer unit 2, the printer unit controller 71 appropriately changes the rotation speed of the heat roller 26 in accordance with a situation in the printer unit 2, particularly, a temperature of the heat roller 26, a type of the medium, or the like. Thereby, the passing speed at which the medium passes through the fixing position is increased and decreased according to need.

The paper feed unit controller 72 is connected to the printer unit controller 71 to communicate with the printer unit controller. Specifically speaking, when receiving the image printing data, the printer unit controller 71 controls the portions of the printer unit 2 and also communicates with the paper feed unit controller 72. With this as a trigger, the paper feed unit controller 72 controls the portions of the paper feed unit 3 and starts a paper loading action.

In the present embodiment, three paper loading modes are prepared. The paper feed unit controller 72 selects one mode from the three paper loading modes, and supplies the medium to the printer unit 2 by a method corresponding to the selected mode. The paper loading mode corresponds to a conveyance mode and is set for a type of the medium supplied to the printer unit 2, in other words, the medium conveyed by the conveyance mechanism 50 in the printer unit 2. Hereinafter, the paper loading mode will be described with reference to FIGS. 10A, 10B, and 10C.

Figure 10A:
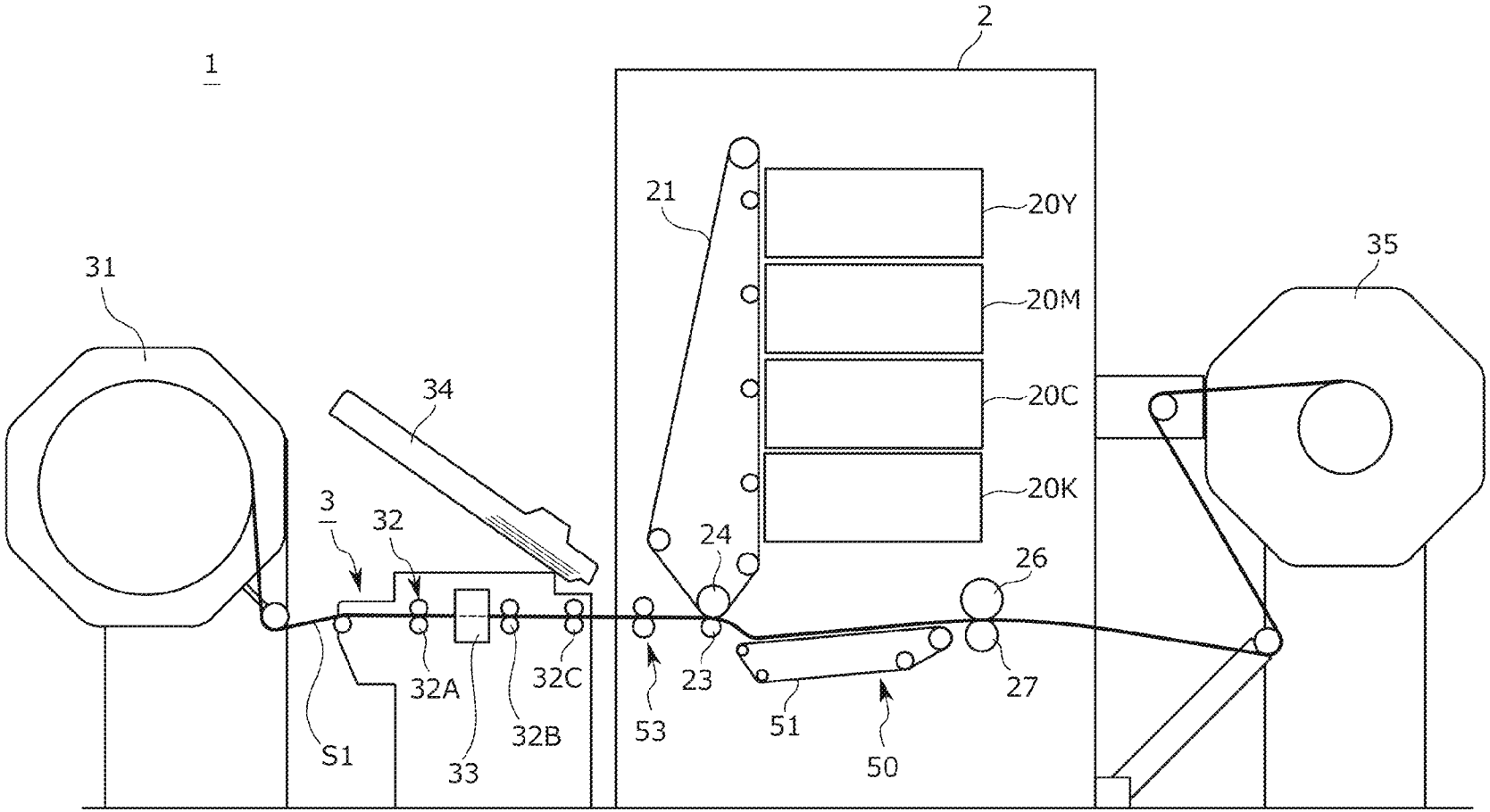
FIG. 10A An illustrative view of a first paper loading mode.

Among the three paper loading modes, a first paper loading mode (corresponding to a first mode) is a mode to convey the die cut label S1 in a state where the die cut label is extended between the unwinder 31 and the rewinder 35 as shown in FIG. 10A. When the first paper loading mode is selected, the paper feed unit controller 72 respectively drives and rotates the unwinder 31, the roll feeder 32, and the rewinder 35 at fixed circumferential speed. Thereby, the die cut label S1 is supplied into the printer unit 2 at fixed supply speed, and a printed part of the die cut label S1 is ejected out of the printer unit 2 at fixed ejection speed.

Meanwhile, in the first paper loading mode, the paper feed unit controller 72 drives the conveyance belt 51 and the intake mechanism 52. Thereby, a part of the die cut label S1 passing through the secondary transfer position is horizontally conveyed in a state where the part is tightly fitted to the upper surface of the conveyance belt 51, and moved toward the fixing position in the printer unit 2.

Figure 10B:
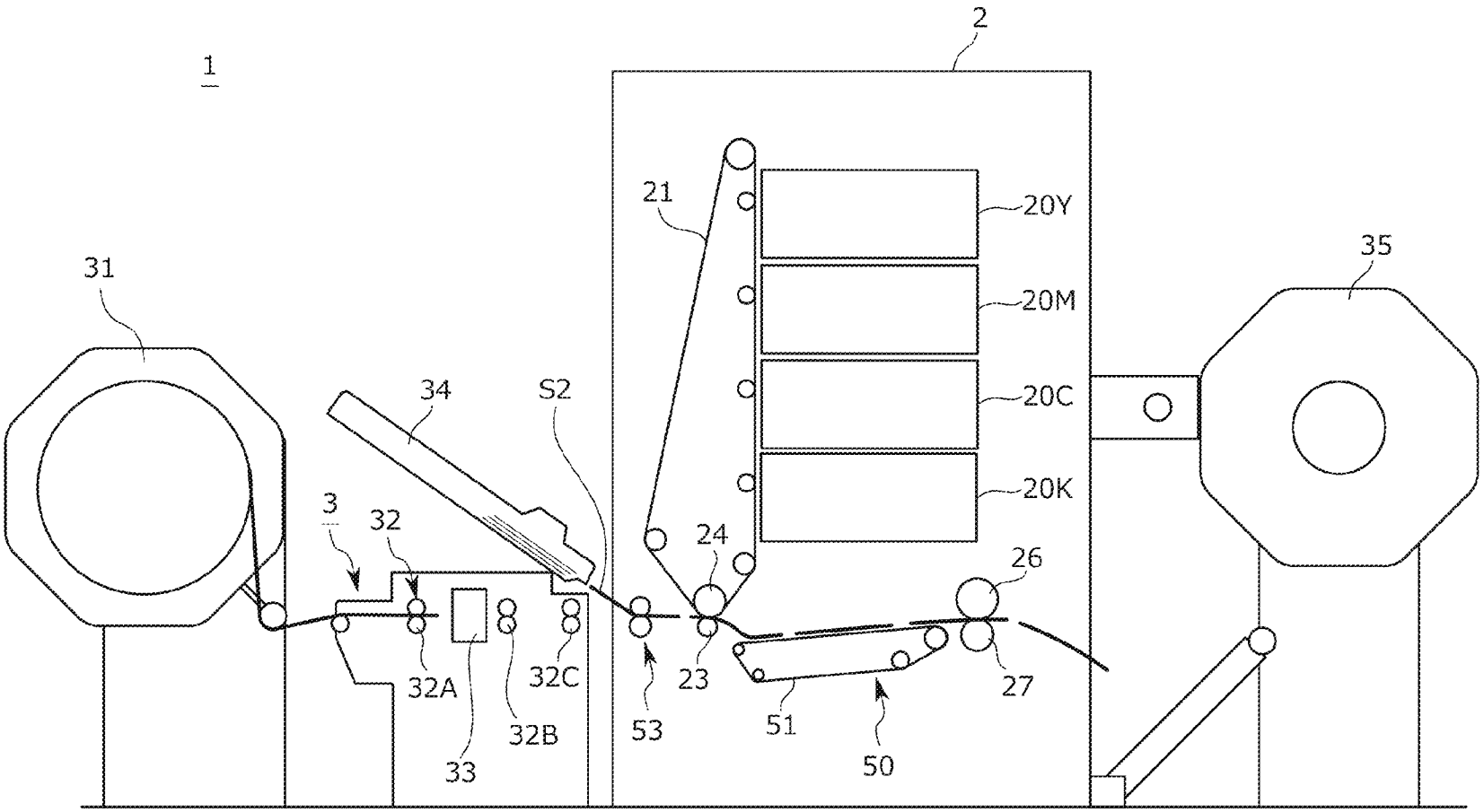
FIG. 10B An illustrative view of a second paper loading mode.

Among the three paper loading modes, a second paper loading mode (corresponding to a second mode) is a mode to load and convey single strip shaped cut papers S2 piled on the tray 34*a* of the cut paper feeder 34 as shown in FIG. 10B. When the second paper loading mode is selected, the paper feed unit controller 72 brings the delivery roller 34*b* into sliding contact with the cut papers S2 on the tray 34*a* while rotating the delivery roller. Thereby, the cut papers S2 on the tray 34*a* are successively taken out from the one longitudinal end of the tray 34*a*, that is, the end on the side close to the printer unit 2. As a result, as many cut papers S2 as a user designates are continuously loaded into the printer unit 2 from the tray 34*a* at fixed supply speed.

In the second paper loading mode, as well as the first paper loading mode, the paper feed unit controller 72 drives the conveyance belt 51 and the intake mechanism 52. Thereby, the cut papers S2 passing through the secondary transfer position are horizontally conveyed in a state where the cut papers are tightly fitted to the upper surface of the conveyance belt 51, and moved toward the fixing position in the printer unit 2. After passing through the fixing position, the cut papers S2 are finally ejected out of the printer unit 2 by the paper ejection rollers 54 and collected by a collection tray (not shown). It should be noted that the cut papers S2 supplied from the cut paper feeder 34 in the second paper loading mode are conveyed in a state where the longitudinal direction thereof is along the conveying direction.

Figure 10C:
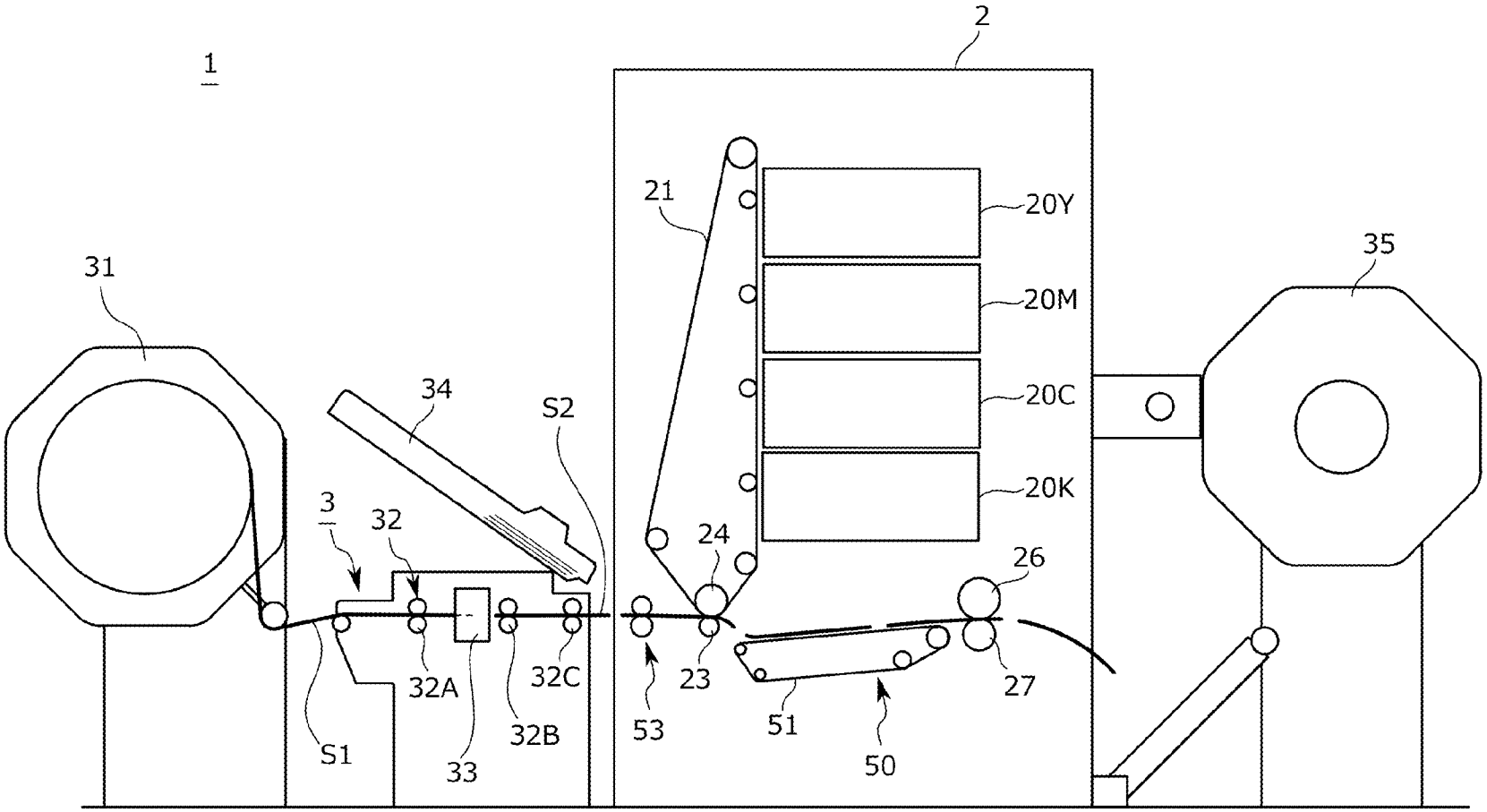
FIG. 10C An illustrative view of a third paper loading mode.

Among the three paper loading modes, a third paper loading mode (corresponding to a third mode) is a mode to create cut papers S2 of predetermined length by cutting the die cut label S1 fed from the unwinder 31 by the cutter unit 33 and convey the created cut papers S2 as shown in FIG. 10C. When the third paper loading mode is selected, the paper feed unit controller 72 drives the unwinder 31, the roll feeder 32, and the cutter unit 33. Thereby, the die cut label S1 fed from the unwinder 31 is cut to have predetermined length (specifically, length to include the predetermined number of adhesive media Sf) at the time of passing through the cutter unit 33. Single strips cut and separated from the die cut label S1, that is, the cut papers S2 are ongoingly moved to the downstream side in the conveying direction by the roll feeder 32, and then come into the printer unit 2.

The subsequent flow of the third paper loading mode is the same as the second paper loading mode. That is, by the paper feed unit controller 72 driving the conveyance belt 51 and the intake mechanism 52, the cut papers S2 passing through the secondary transfer position are horizontally conveyed in a state where the cut papers are tightly fitted to the upper surface of the conveyance belt 51, and moved toward the fixing position in the printer unit 2. After passing through the fixing position, the cut papers S2 are finally ejected out of the printer unit 2 by the paper ejection rollers 54 and collected by the collection tray (not shown).

While the third paper loading mode is executed, the length of the created cut papers S2 is adjusted by the paper feed unit controller 72 controlling timing of cutting by the cutter unit 33. That is, in the third paper loading mode, the length of the cut papers S2 created by cutting the roll shaped label paper by the cutter unit 33 (strictly speaking, the length along the conveying direction when the cut papers S2 are in a conveying state) is variable. Therefore, the length of the cut papers S2 created upon selecting the third paper loading mode can be set to be longer than for example, length of normal cut papers S2 (specifically, the cut papers S2 supplied from the cut paper feeder 34).

As described above, in the printer 1, one paper loading mode can be selected from the three kinds of paper loading modes. That is, the configuration of the printer 1 is useful in a point that there are a relatively great number of variations of a method of supplying the medium and realizes a highly versatile label printer.

<<Characteristic Configuration of Label Printer According to the Present Embodiment and Effectiveness Thereof>>

Next, a characteristic configuration of the printer 1 and effectiveness thereof will be described.

In the printer 1, when the first paper loading mode is selected, the roll shaped die cut label S1 is supplied into the printer unit 2 as the medium. The part of the die cut label S1 where the image is printed (strictly speaking, the part where the color toner image is fixed) is collected by the rewinder 35 while the part remains in a roll shape. In such a way, in the first paper loading mode, in a state where the die cut label S1 is extended between the unwinder 31 and the rewinder 35, the color toner image is transferred (secondary transfer) and fixed to the die cut label S1. That is, the parts of the die cut label S1 are nipped by the pair of rollers for secondary transfer (specifically, the secondary transfer roller 23 and the opposing roller 24) after fed out until taken up and further nipped by the pair of fixing rollers 26, 27 on the downstream side thereof.

When thickness, a type (material), or the like of the die cut label S1 to be used is changed, the heating temperature of one of the fixing rollers 26, 27, that is, the heat roller 26 is changed. Further, in accordance with the change in the heating temperature, an outer diameter of the heat roller 26 is changed. As a result, even when the heat roller 26 is rotated always at the same rotation speed, the outer diameter is changed as described above, so that circumferential speed of the heat roller 26 is changed.

Meanwhile, the intermediate transfer belt 21, the secondary transfer roller 23, and the opposing roller 24 are rotated always at the same circumferential speed in synchronization with each other during image printing processing. This is because there is a need for stabilizing transfer speed upon correctly transferring the color toner image held on the intermediate transfer belt 21 to the medium. When the circumferential speed of the intermediate transfer belt 21, the secondary transfer roller 23, and the opposing roller 24 is fixed but the circumferential speed of the heat roller 26 is changed as described above, slack is generated or extinguished in a part of the die cut label S1 between the secondary transfer position and the fixing position.

Specifically speaking, when the outer diameter of the heat roller 26 is increased and the circumferential speed of the roller is increased, a slack degree is reduced in the part of the die cut label S1 between the secondary transfer position and the fixing position. If the slack is completely extinguished, the die cut label S1 is pulled toward the fixing position and brought into a strained posture. As a result, there is a fear that the color toner image is not correctly transferred.

Meanwhile, when the outer diameter of the heat roller 26 is reduced and the circumferential speed of the roller is decreased, the slack degree is increased in the part of the die cut label S1 between the secondary transfer position and the fixing position. At this time, when the slack is excessively generated, there is a fear that a jam is generated immediately before the fixing position. As described above, there is a need for stabilizing the degree of the slack generated in the part of the die cut label S1 where the color toner image is transferred or later to be a proper amount. That is, excess or shortage of the slack generates failure such as the jam and transfer failure, and badly influences quality of an image to be printed at the end.

Thus, in the printer 1, a configuration for adjusting the slack of the die cut label S1 to be a proper amount on the downstream side of the secondary transfer position irrespective of a type of the die cut label S1 when the image is printed to the roll shaped die cut label S1 is adopted. Such a configuration will be described. A sensor for detecting the slack degree is installed in the printer unit 2, and in accordance with a detection result of such a sensor, the rotation speed of the heat roller 26 is controlled.

Hereinafter, the configuration for adjusting the above slack will be described more in detail with reference to FIGS. 6 to 8. The above slack is generated in the part of the die cut label S1 ranging from the secondary transfer position (that is, the position nipped between the transfer roller 23 and the opposing roller 24) to the fixing position (that is, the position nipped between the pair of fixing rollers 26, 27).

More strictly speaking, the conveyance belt 51 described above is arranged between the secondary transfer position and the fixing position in the conveying direction. In the present embodiment, the upper surface of the conveyance belt 51 on which the medium is mounted is placed at a position on the lower side of the secondary transfer position and the fixing position as shown in FIG. 6. Specifically speaking, an upstream side end portion 55*a* in the conveying direction of the upper surface (mount surface) of the conveyance belt 51 is placed on the slightly lower side of the nipping portion formed between the secondary transfer roller 23 and the opposing roller 24. The upper surface (mount surface) of the conveyance belt 51 is an inclined surface in such a manner that a downstream side end is placed on the upper side of an upstream side end in the conveying direction. Further, a downstream side end portion in the conveying direction of the upper surface (mount surface) of the conveyance belt 51 is placed on the lower side of the nipping portion formed between the fixing rollers 26, 27 and extends toward the nipping portion.

Meanwhile, the intake mechanism 52 described above is arranged in the conveyance belt 51. When such an intake mechanism 52 performs the air intake action, a part of the die cut label S1 placed on the upper side of the conveyance belt 51 is tightly fitted to the upper surface of the conveyance belt 51 as shown in FIG. 6. At this time, in a normal state, a part of the die cut label S1 placed on the downstream side of the secondary transfer position in the conveying direction and on the upstream side of the conveyance belt 51 is curved in an arc shape as shown in FIG. 6 to form slack. This is because the upper surface of the conveyance belt 51 is arranged at a position below the nipping portion formed between the transfer roller 23 and the opposing roller 24, that is, the secondary transfer position.

Figure 6:
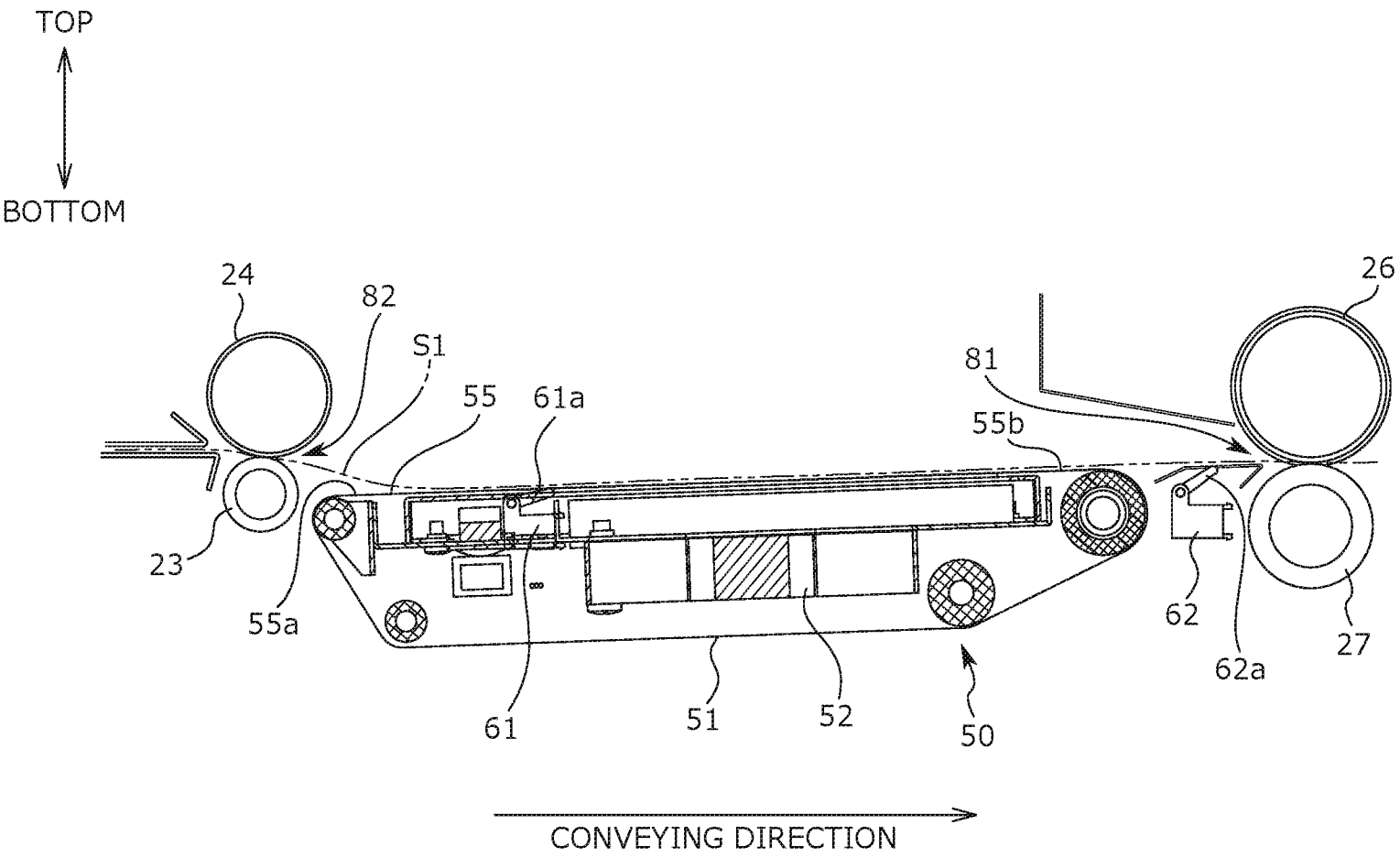
FIG. 6 An illustrative view relating to a configuration of a conveyance mechanism.

Apart of the die cut label S1 placed on the downstream side of the conveyance belt 51 in the conveying direction and on the upstream side of the fixing position extends toward the fixing position with almost no slack as shown in FIG. 6. In other words, when the upper surface of the conveyance belt 51 virtually extends to the downstream side in the conveying direction, the fixing position, that is, the nipping portion between the fixing rollers 26, 27 is placed ahead. Thereby, in a normal state, the parts of the die cut label S1 are smoothly brought to the fixing position. Such an effect is particularly effective in a case where a short medium is used.

It should be noted that the effect that the medium is smoothly brought to the part between the pair of fixing rollers 26, 27 is also effective in the second paper loading mode and the third paper loading mode. That is, when the cut paper S2 is conveyed by the conveyance belt 51, a part of the cut paper S2 separated from the downstream side end portion 55*b* in the conveying direction of the upper surface of the conveyance belt 51 (hereinafter, referred to as the belt separate part) does not receive an intake operation by the intake mechanism 52. Thus, the moving direction of the part is not easily regulated. In contrast, in the present embodiment, as described above, the downstream side end portion in the conveying direction of the upper surface of the conveyance belt 51 extends toward the nipping portion between the pair of fixing rollers 26, 27. Thereby, even the belt separate part of the cut paper S2 is smoothly brought to the fixing position. As a result, stuck cut papers S2 at a position immediately before the fixing position, that is, the jam can be effectively suppressed.

Figure 7:
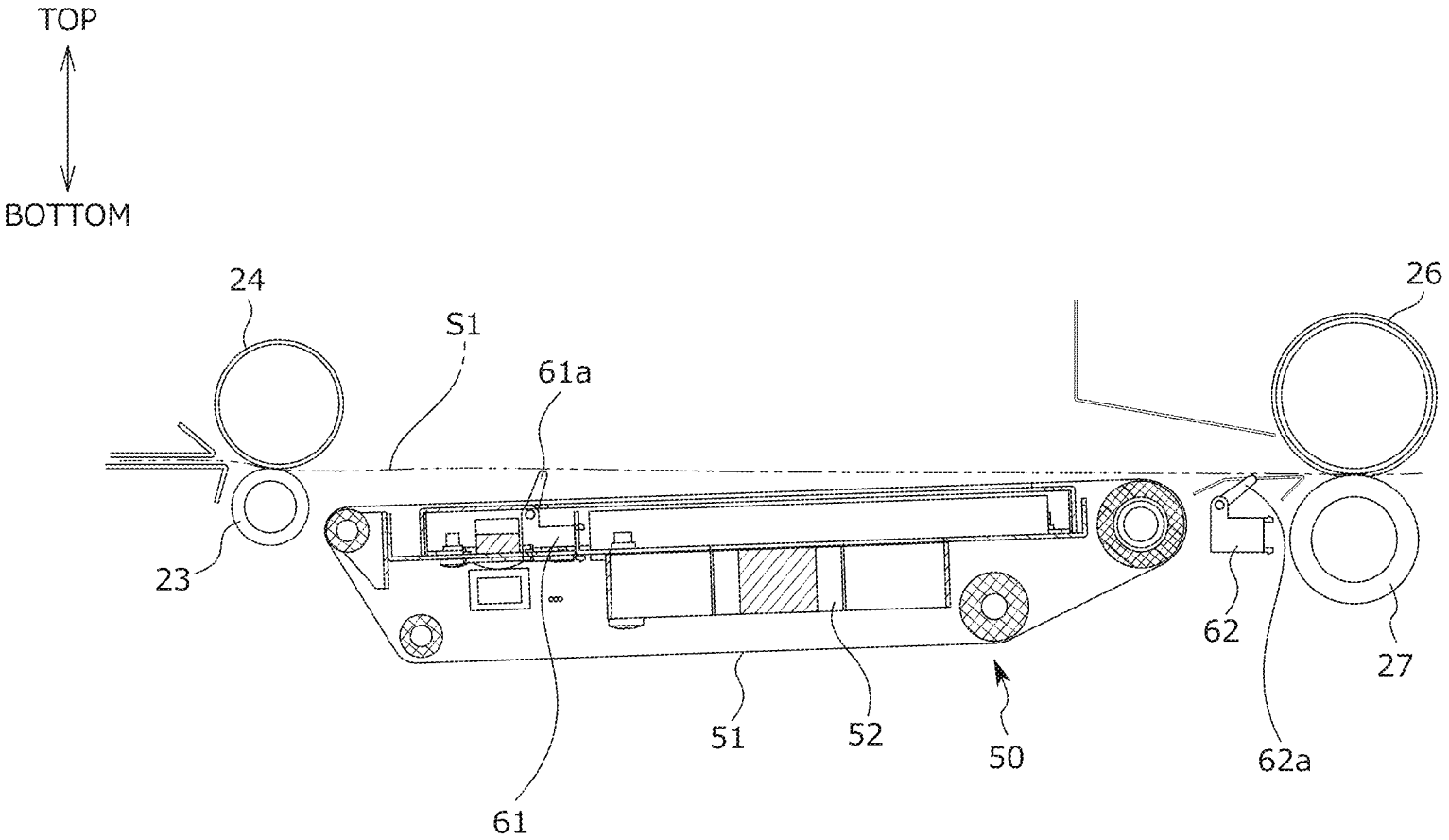
FIG. 7 A view showing a state of the conveyance mechanism when there is no slack in a roll shaped medium.

When the slack is generated in the part of the die cut label S1 ranging from the secondary transfer position to the fixing position and the circumferential speed of the heat roller 26 is increased, the slack degree is reduced, and the die cut label S1 is tensioned as shown in FIG. 7. In such a state, although the intake mechanism 52 performs the air intake action, the part of the die cut label S1 ranging from the secondary transfer position to the fixing position is not mounted on the upper surface of the conveyance belt 51 but brought into a strained posture. In other words, the part of the die cut label S1 ranging from the secondary transfer position to the fixing position substantially linearly extends from the secondary transfer position to the fixing position as shown in FIG. 7 when the slack is eliminated due to an increase in the circumferential speed of the heat roller 26.

Figure 8:
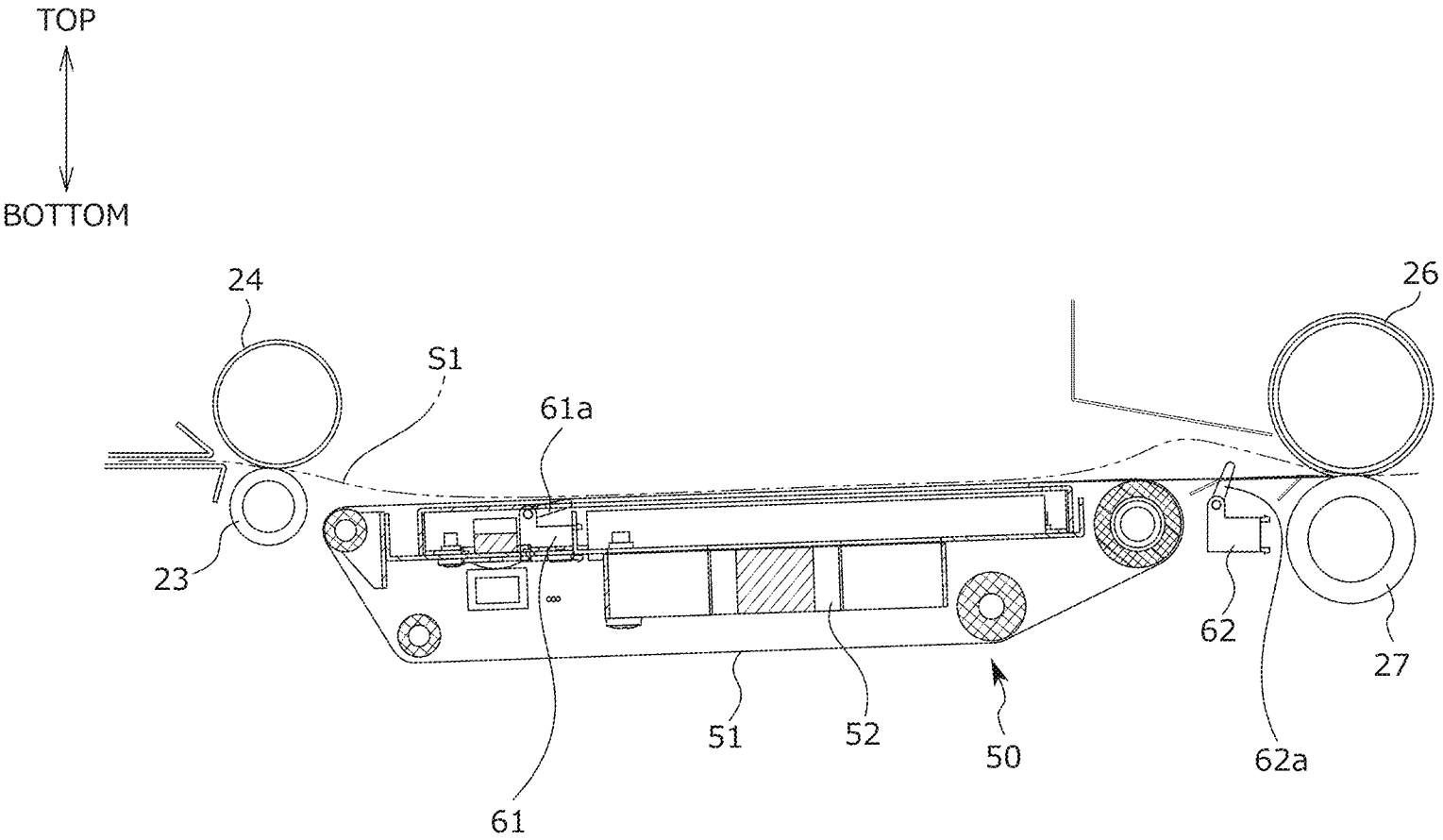
FIG. 8 A view showing a state of the conveyance mechanism when the slack is excessive in the roll shaped medium.

On the other hand, when the slack is generated in the part of the die cut label S1 ranging from the secondary transfer position to the fixing position and the circumferential speed of the heat roller 26 is decreased, the slack degree is increased, and for example, another slack is separately generated at a position immediately before the fixing position as shown in FIG. 8. That is, the slack degree in the part of the die cut label S1 ranging from the secondary transfer position to the fixing position becomes excessively large.

As described above, the slack degree in the part of the die cut label S1 ranging from the secondary transfer position to the fixing position is varied in accordance with the circumferential speed of the heat roller 26. Therefore, in the printer 1, sensors serving as detectors (hereinafter, referred to as the slack detection sensors 61, 62) are installed in order to monitor the above slack degree. The printer unit controller 71 adjusts the rotation speed of the heat roller 26 in accordance with a detection result of the slack degree.

More in detail, the two slack detection sensors 61, 62 are used in the printer 1, and the sensors are installed at positions different from each other in the conveying direction. That is, in the printer 1, the slack degree in the part of the die cut label S1 ranging from the secondary transfer position to the fixing position is monitored at two points. More specifically speaking, the slack detection sensor 61 on one side (hereinafter, also referred to as the upstream side slack detection sensor 61) is arranged at a position closer to the upstream side end among the upstream side end and the downstream side end of the upper surface of the conveyance belt 51 in the conveying direction. That is, the upstream side slack detection sensor 61 is installed in order to detect the slack degree of the die cut label S1 on the side closer to the secondary transfer position among the secondary transfer position and the fixing position.

The slack detection sensor 62 on the other side (hereinafter, also referred to as the downstream side slack detection sensor 62) is arranged at a position on the downstream side of the conveyance belt 51 in the conveying direction and on the upstream side of the fixing position. That is, the downstream side slack detection sensor 62 is installed in order to detect the slack degree of the die cut label S1 on the side closer to the fixing position among the secondary transfer position and the fixing position.

As described above, in the printer 1, the slack degree of the die cut label S1 is respectively detected on the side closer to the secondary transfer position and on the side closer to the fixing position. Thus, excess or shortage of the slack degree can be properly grasped.

It should be noted that any configuration of the slack detection sensors 61, 62 can be utilized without restriction as long as the slack detection sensors detect the slack of the roll shaped medium. In the printer 1, interrupter type photo sensors are utilized as the slack detection sensors 61, 62. A configuration of such sensors will be described. The slack detection sensors 61, 62 respectively include levers 61*a*, 62*a* that stand up and fall down in accordance with the slack degree of the die cut label S1. The slack detection sensors 61, 62 output signals indicating a standing/falling state of the levers 61*a*, 62*a* as signals in accordance with the slack degree of the die cut label S1.

More specifically speaking, the lever 61*a* of the upstream side slack detection sensor 61 falls down as shown in FIG. 6 when the slack degree of the die cut label S1 (strictly speaking, the slack degree on the side closer to the secondary transfer position) is a proper amount, and stands up as shown in FIG. 7 in a case where there is no slack. The upstream side slack detection sensor 61 has a light emitting portion and a light receiving portion (not shown). When the lever 61*a* is in a standing state, light from the light emitting portion reaches the light receiving portion, and when the lever 61*a* is in a falling state, the light from the light emitting portion is blocked by the lever 61*a*. The upstream side slack detection sensor 61 outputs an ON signal in a case where the light from the light emitting portion is blocked, and outputs an OFF signal in a case where the light from the light emitting portion reaches the light receiving portion.

On the other hand, the lever 62*a* of the downstream side slack detection sensor 62 falls down as shown in FIG. 6 when the slack degree of the die cut label S1 (strictly speaking, the slack degree on the side closer to the fixing position) is a proper amount, and stands up as shown in FIG. 8 in a case where the slack is excessive. The downstream side slack detection sensor 62 has a light emitting portion and a light receiving portion (not shown). When the lever 62*a* is in a standing state, light from the light emitting portion reaches the light receiving portion, and when the lever 62*a* is in a falling state, the light from the light emitting portion is blocked by the lever 62*a*. The downstream side slack detection sensor 62 outputs an ON signal in a case where the light from the light emitting portion is blocked, and outputs an OFF signal in a case where the light from the light emitting portion reaches the light receiving portion.

As described above, in the printer 1, the interrupter type photo sensors are used as the slack detection sensors 61, 62, and the slack degree of the die cut label S1 is specified by the signals outputted from both the slack detection sensors 61, 62. Specifically speaking, in a normal state, that is, when the slack degree in the part of the die cut label S1 ranging from the secondary transfer position to the fixing position is within a normal range, the levers 61*a*, 62*a* of the two slack detection sensors 61, 62 are both in a falling state as shown in FIG. 6. Therefore, in a normal state, the two slack detection sensors 61, 62 output the ON signals.

Meanwhile, when the above slack degree is smaller than a predetermined value, that is, when the part of the die cut label S1 ranging from the secondary transfer position to the fixing position is strained without any slack as shown in FIG. 7, the lever 61*a* of the upstream side slack detection sensor 61 is in a standing state. In contrast, the lever 62*a* of the downstream side slack detection sensor 62 is in a falling state. Therefore, when there is no slack, the upstream side slack detection sensor 61 outputs the OFF signal and the downstream side slack detection sensor 62 outputs the ON signal.

On the other hand, when the above slack degree is larger than the predetermined value, that is, when excessive slack is generated in the part of the die cut label S1 ranging from the secondary transfer position to the fixing position as shown in FIG. 8, the lever 61*a* of the upstream side slack detection sensor 61 is in a falling state. In contrast, the lever 62*a* of the downstream side slack detection sensor 62 is in a standing state. Therefore, when excessive slack is generated, the upstream side slack detection sensor 61 outputs the ON signal and the downstream side slack detection sensor 62 outputs the OFF signal.

When the signals are outputted from the slack detection sensors 61, 62, the printer unit controller 71 controls the rotation speed of the heat roller 26 in accordance with the output signals. Thereby, the slack degree in the part of the die cut label S1 ranging from the secondary transfer position to the fixing position is adjusted to be within a preliminarily set range, specifically, the slack degree shown in FIG. 6.

Control of the rotation speed of the heat roller 26 will be described. In a case shown in FIG. 6, that is, in a case where the slack degree in the part of the die cut label S1 ranging from the secondary transfer position to the fixing position is within a proper range, the printer unit controller 71 maintains the rotation speed of the heat roller 26 at the speed of the time.

Meanwhile, in a case shown in FIG. 7, that is, in a case where the part of the die cut label S1 ranging from the secondary transfer position to the fixing position is strained, the printer unit controller 71 receives the OFF signal from the upstream side slack detection sensor 61 and receives the ON signal from the downstream side slack detection sensor 62. After that, the printer unit controller 71 decreases the rotation speed of the heat roller 26 lower than speed of normal time. As a result, length of the part of the die cut label S1 ranging from the secondary transfer position to the fixing position is gradually increased, and the slack is generated in the part. The printer unit controller 71 finally maintains the rotation speed of the heat roller 26 at speed when the slack degree is brought into a proper range.

On the other hand, in a case shown in FIG. 8, that is, in a case where excessive slack is generated in the part of the die cut label S1 ranging from the secondary transfer position to the fixing position (strictly speaking, the position immediately before the fixing position) the printer unit controller 71 receives the ON signal from the upstream side slack detection sensor 61 and receives the OFF signal from the downstream side slack detection sensor 62. After that, the printer unit controller 71 increases the rotation speed of the heat roller 26 higher than the speed of normal time. As a result, the length of the part of the die cut label S1 ranging from the secondary transfer position to the fixing position is gradually reduced, and the excessive slack generated in the part (strictly speaking, the position immediately before the fixing position) is eliminated. The printer unit controller 71 finally maintains the rotation speed of the heat roller 26 at speed when the slack degree is brought into a proper range.

As described above, in the printer 1, while the printing processing is performed in the first paper loading mode, the printer unit controller 71 controls the rotation speed of the heat roller 26 in accordance with the output signals from the slack detection sensors 61, 62. Thereby, even when size of the outer diameter of the heat roller 26 is changed, the slack degree in the part of the die cut label S1 ranging from the secondary transfer position to the fixing position is adjusted to be a proper amount. As a result, the jam and the transfer failure generated due to excess or shortage of the slack are suppressed, so that the quality of the printed image is improved.

OTHER EMBODIMENTS

In the above embodiment, one example is described mainly for the configuration of the label printer of the present invention. However, the above embodiment is not to limit the present invention but only to provide one example for facilitating understanding of the present invention. The present invention can be modified and improved without departing from the gist thereof, and the present invention includes equivalent items thereof as a matter of course.

In the above embodiment, the toner image formation units 20Y, 20M, 20C, 20K of four colors of YMCK are arranged side by side in the up and down direction. Further, in the above embodiment, when the part of the intermediate transfer belt 21 where the color toner image is held passes through the part between the secondary transfer roller 23 and the opposing roller 24 (nipping portion), the above color toner image is transferred to the medium. That is, in the above embodiment, the color toner image is collectively transferred at one point in the conveyance route for the medium in the printer unit 2. However, the present invention is not limited to this but for example, the toner image formation units 20Y, 20M, 20C, 20K of four colors of YMCK may be arranged in a laterally placed state, that is, in a state where the toner image formation units are placed side by side along the conveyance route. In such a case, the toner images of different colors are individually transferred at plural points in the conveyance route for the medium.

Meanwhile, when the toner image formation units 20Y, 20M, 20C, 20K are arranged side by side in the up and down direction as in the above embodiment, a space for providing the slack in the die cut label S1 is easily ensured in the printer unit 2. That is, the slack is more easily provided in the above embodiment than a configuration that the toner image formation units 20Y, 20M, 20C, 20K of four colors of YMCK are laterally arranged side by side.

In a case where the color toner image is collectively transferred at one point in the conveyance route for the medium, the number of the point where the toner image is transferred, specifically, the number of the point where the medium is nipped between the pair of transfer rollers is reduced in comparison to the configuration that the toner images of different colors are individually transferred at plural points in the conveyance route for the medium. The more the number of the point where the toner image is transferred is reduced, the more the number of abutment with the medium is reduced. Thus, when the die cut label S1 is used as the medium, the adhesive media Sf are less likely to be detached from the release paper Sb. Therefore, from a viewpoint of avoiding detachment of the adhesive media Sf, the color toner image is more favorably collectively transferred at one point in the conveyance route for the medium.

In the above embodiment, the two slack detection sensors 61, 62 are used in order to detect the slack degree in the part of the die cut label S1 ranging from the secondary transfer position to the fixing position in the first paper loading mode. One of the two slack detection sensors 61, 62 detects the slack degree on the side closer to the secondary transfer position, and the other sensor detects the slack degree on the side closer to the fixing position. However, the number of sensors for detecting the slack is not particularly limited. For example, in a case where a sensor capable of detecting a slack amount with high precision such as a distance sensor is used, only one sensor may be arranged. However, in a case where the interrupter type photo sensors which are relatively inexpensive are used as the sensors for detecting the slack as in the above embodiment, the plurality of sensors may be arranged at positions different from each other in the conveying direction, and at least one sensor may be arranged on the side close to the secondary transfer position, and at least one sensor may be arranged on the side close to the fixing position.

Figure 9:
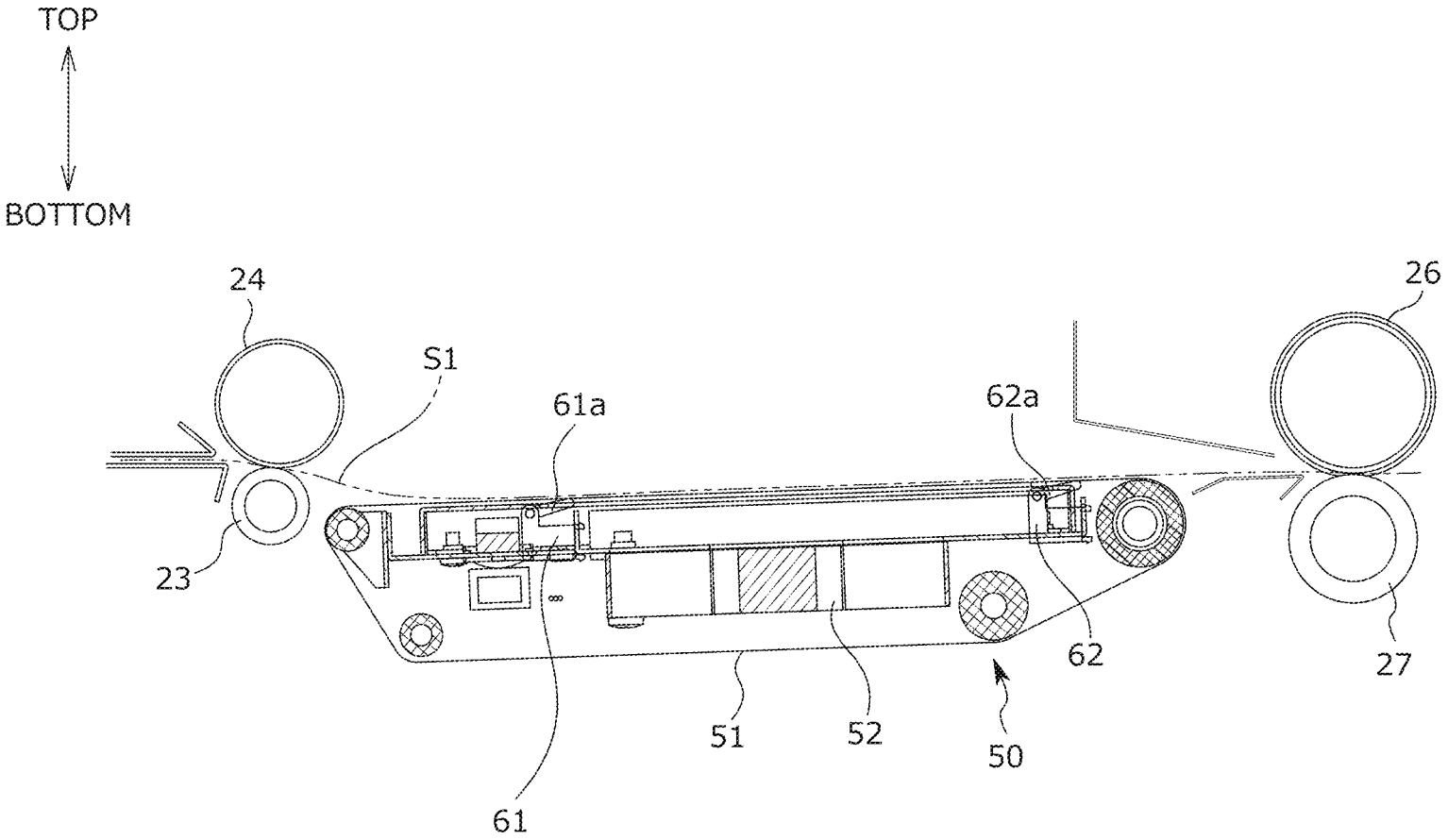
FIG. 9 A view showing a modified example of the conveyance mechanism.

An arrangement position of the sensor for detecting the slack is also not particularly limited. For example, the downstream side slack detection sensor 62 may be arranged at a position on the slightly upstream side of the arrangement position shown in FIG. 6, specifically, on the upstream side of the downstream side end in the conveying direction of the conveyance belt 51 as shown in FIG. 9.

In the above embodiment, the endless intermediate transfer belt 21 is provided as an intermediate transfer body for the toner image. However, the present invention is not limited to this but an intermediate transfer drum may be provided.

In the above embodiment, when the medium passes through the part between the secondary transfer roller 23 and the opposing roller 24, the toner image held on the intermediate transfer belt 21 is transferred to the medium by the electric field formed between the rollers. However, the present invention is not limited to this but a transfer method of using a belt instead of the rollers or a method of transferring a toner image after electrically charging the medium with a corona charger (corona transfer method) may be adopted. It should be noted that the pass-through portion for the medium provided in the transfer portion is formed differently in accordance with the transfer method needless to say but corresponds to a part through which the medium actually passes at the time of transfer.

In the above embodiment, the toner image is fixed by nipping the medium between the heated heat roller 26 and the backup roller 27. However, the present invention is not limited to this but a fixing method of using a belt instead of the rollers or a method of fusing the transfer image with irradiation light from a xenon lamp (flash fixing method) may be adopted. It should be noted that the pass-through portion for the medium provided in the fixing portion is formed differently in accordance with the fixing method needless to say but corresponds to a part through which the medium actually passes at the time of fixing.

In the above embodiment, the rotation speed of the fixing roller (heat roller 26) is controlled in order to adjust the slack degree of the die cut label S1. However, an object to be controlled is not limited to the rotation speed of the fixing roller. As long as the passing speed at which the medium passes through the pass-through portion provided in the fixing portion (fixing unit) is adjusted, speed other than the rotation speed of the fixing roller may be controlled. For example, in a case where fixing is performed by a non-contact heating method such as the flash fixing method, drive speed of rollers, a belt, or other delivery mechanisms that deliver the medium to the downstream side in the vicinity of the fixing point (in other words, delivery speed of the medium) may be controlled.

However, when the rotation speed of the heat roller 26 is controlled as in the above embodiment, the effects of the present invention are more effectively exerted. Specifically speaking, the heating temperature of the heat roller 26 is changed in accordance with a type (thickness or material) of the medium to which the image is printed, and the outer diameter of the heat roller 26 is changed in accordance with the temperature at the time and the circumferential speed of the heat roller 26 is accordingly changed. Thereby, the passing speed at which the medium passes through the part between the heat roller 26 and the backup roller 27 is changed. As a result, the slack degree of the medium is changed. In such a situation, adjustment of the rotation speed of the heat roller 26 is a favorable configuration upon fixing and maintaining the slack degree, so that the effects of the present invention are more effectively exerted.

In the above embodiment, the intermediate transfer belt 21 is controlled to have fixed circumferential speed in order to fix and maintain the transfer speed during image printing, and the primary transfer rollers 22, the secondary transfer roller 23, and the opposing roller 24 to be abutted with this are driven and rotated. However, an object to be controlled is different in accordance with the adopted transfer method as a matter of course. For example, in a case where the corona transfer method is adopted, a holding body that holds the toner image before transfer and rollers, a belt, or other delivery mechanisms that deliver the medium to the downstream side in the vicinity of the corona charger are used, and drive speed of these may be controlled to be fixed.

In the above embodiment, the endless conveyance belt 51 is provided as the mechanism for conveying the medium in the printer unit 2, that is, the conveyance mechanism main body. However, the present invention is not limited to this but a conveyance drum that conveys the medium by being rotated while holding the medium on a peripheral surface may be provided.

In the above embodiment, at the time of executing the first paper loading mode, that is, in a case of printing the image to the roll shaped medium, the slack of the above medium is adjusted. However, the present invention is not limited to this. As well as the first paper loading mode, the slack may be adjusted when the third paper loading mode is executed. Specifically speaking, the length of the medium created by cutting the roll shaped medium (that is, the cut paper S2) in the third paper loading mode is variable as described above, and may sometimes be not less than a distance between the secondary transfer position and the fixing position (interval length between the secondary transfer position and the fixing position in the conveyance route). In such a case, when the cut paper S2 is placed over both the secondary transfer position and the fixing position, the slack can be generated in apart of the cut paper S2 between the secondary transfer position and the fixing position. At this time, the slack degree may be adjusted by the same procedure as the time of executing the first paper loading mode. That is, at the time of executing the third paper loading mode, when the length of the created cut paper S2 is not less than the interval length between the secondary transfer position and the fixing position, the printer unit controller 71 may control the rotation speed of the heat roller 26 in accordance with the output signals from the slack detection sensors 61, 62 in order to bring the slack degree into a preliminarily set range. Thereby, in a case where the image is printed to the relatively long cut paper S2 under execution of the third paper loading mode, the slack degree is adjusted to be a proper amount and the failure generated due to excess or shortage of the slack is avoided, so that the quality of the printed image can be improved.

1: Printer (label printer)
2: Printer unit (printer unit)
2A: Casing
3: Paper feed unit (medium supply unit)
4: Base
20Y, 20M, 20C, 20K: Toner image formation unit
21: Intermediate transfer belt
22: Primary transfer roller
23: Secondary transfer roller
24: Opposing roller
25: Belt cleaner
26: Fixing roller, heat roller
27: Fixing roller, backup roller
31: Unwinder (feed roller)
32: Roll feeder (take-up roller)
32A, 32B, 32C: Conveyance roller
33: Cutter unit (cutter)
34: Cut paper feeder (supplying mechanism)
34*a*: Tray
34*b*: Delivery roller
35: Rewinder
41: Toner cartridge
42: Housing
43: Supply roller
44: Developing roller
45: Regulation blade
46: Photosensitive drum
47: Electrifier
48: Photosensitive drum cleaner
49: Electric remover
50: Conveyance mechanism
51: Conveyance belt (conveyance mechanism main body)
52: Intake mechanism.
53: Paper loading roller
54: Paper ejection roller
61, 62: Slack detection sensor (detector)
61*a*, 62*a*: Lever
71: Printer unit controller (second control unit)
72: Paper feed unit controller (first control unit)
S1: Die cut label (first medium)
S2: Cut paper (second medium)
Sb: Release paper
Sf: Adhesive medium
55: Mount surface
55*a*: Upstream side end portion
55*b*: Downstream side end portion
81: First pass-through portion
82: Second pass-through portion

The invention claimed is:

1. An electrographic type label printer, comprising:

a printer unit that transfers a toner image to a medium and prints an image to the medium;

a medium supply unit that supplies the medium to the printer unit;

a first control unit that controls the medium supply unit; and a second control unit that controls the printer unit, wherein the printer unit comprises:

a transfer portion that transfers the toner image to the medium; and a fixing portion that fixes the toner image transferred to the medium, the medium supply unit comprises:

a feed roller that feeds a first medium serving as the medium, the first medium having a roll shape;

a take-up roller that takes up a part of the first medium where the image is printed;

a cutter arranged between the feed roller and the take-up roller, the cutter that cuts the first medium;

a supplying unit that retains and supplies a second medium serving as the medium, the second medium having a single strip shape;

a conveyance unit that conveys the medium in the printer unit, the conveyance unit being placed on a downstream side of the transfer portion in a conveying direction of the medium and on an upstream side of the fixing portion; and a detector that detects a slack degree of the medium between the transfer portion and the fixing portion in the conveying direction, and outputs a signal in accordance with the slack degree, the conveyance unit comprises:

a conveyance unit main body that conveys the medium by moving a mount surface for the medium in a state where the mount surface faces an upper side; and an intake unit that performs an air intake action for tightly fitting the medium to the mount surface, the first control unit is capable of selecting a conveyance mode of the medium by the conveyance unit from a first ode to convey the first medium extended between the feed roller and the take-up roller, a second mode to convey the second medium supplied from the supplying unit, and a third mode to convey the second medium created by cutting the first medium which is fed from the feed roller by the cutter, passing speed at which the medium passes through a pass-through portion provided in the fixing portion is variable, when the first control unit selects the first mode, the second control unit controls the passing speed in accordance with an output signal from the detector in order to adjust the slack degree within a preliminarily set range, the plurality of detectors are provided at positions different from each other in the conveying direction, one of the detectors detects the slack degree of the medium on a side closer to the transfer portion among the transfer portion and the fixing portion, and an other detector detects the slack degree of the medium on a side closer to the fixing portion among the transfer portion and the fixing portion.

2. The label printer according to claim 1, further comprising a first pass-through portion that is provided in the fixing portion and through which the medium passes, the first pass-through portion being the pass-through portion, and a second pass-through portion that is provided in the transfer portion and through which the medium passes, wherein the mount surface comprises:

a downstream end portion provided at an end portion of the mount surface on a downstream side in the conveying direction of the medium; and an upstream end portion provided at an end portion of the mount surface on an upstream side in the conveying direction of the medium, the mount surface is inclined in such a manner that the downstream end portion is placed at a higher position than the upstream end portion, the upstream end portion of the mount surface is placed at a lower position than the second pass-through portion, and the downstream end portion of the mount surface extends toward the first pass-through portion.

3. The label printer according to claim 1, wherein the second control unit controls to maintain passing speed at which the medium passes through the pass-through portion provided in the transfer portion at fixed speed while the printer unit prints the image to the medium.

4. The label printer according to claim 1, wherein the printer unit comprises:

a plurality of toner image formation units that forms the toner images of color different from each other, and an endless intermediate transfer belt to which the toner images of different colors formed by the plurality of toner image formation units are successively transferred, the intermediate transfer belt being rotated while holding a color toner image formed by superimposing the toner images of different colors on each other, the plurality of toner image formation units are arranged side by side in an up and down direction, and the color toner image is transferred to the medium when a part of the intermediate transfer belt where the color toner it is held passes through the pass-through portion provided in the transfer portion together with the medium.

5. The label printer according to claim 1, wherein each of the plurality of detectors comprises a lever that stands up and falls down in accordance with the slack degree and outputs a signal indicating a standing/falling state of the lever as a signal in accordance with the slack degree, when the medium is extended without any slack, the detector that detects the slack degree of the medium on the side closer to the transfer portion outputs an OFF signal indicating that the lever is in a standing state, and the detector that detects the slack degree of the medium on the side closer to the fixing portion outputs an ON signal indicating that the lever is in a falling state, and when receiving the OFF signal from the detector that detects the slack degree of the medium on the side closer to the transfer portion and receiving the ON signal from the detector that detects the slack degree of the medium on the side closer to the fixing portion, the second control unit decreases the passing speed at which the medium passes through the pass-through portion provided in the fixing portion.

6. The label printer according to claim 5, wherein when excessive slack is generated in the medium, the detector that detects the slack degree of the medium on the side closer to the transfer portion outputs an ON signal indicating that the lever is in a falling state, and the detector that detects the slack degree of the medium on the side closer to the fixing portion outputs an OFF signal indicating that the lever is in a standing state, and when receiving the ON signal from the detector that detects the slack degree of the medium on the side closer to the transfer portion and receiving the OFF signal from the detector that detects the slack degree of the medium on the side closer to the fixing portion, the second control unit increases the passing speed at which the medium passes through the pass-through portion provided in the fixing portion.

7. An electrographic type label printer, comprising:

a printer unit that transfers a toner image to a medium and prints an image to the medium;

a medium supply unit that supplies the medium to the printer unit;

a first control unit that controls the medium supply unit; and a second control unit that controls the printer unit, wherein the printer unit comprises:

a transfer portion that transfers the toner image to the medium; and a fixing portion that fixes the toner image transferred to the medium, the medium supply unit comprises:

a feed roller that feeds a first medium serving as the medium, the first medium having a roll shape;

a take-up roller that takes up a part of the first medium where the image is printed;

a cutter arranged between the feed roller and the take-up roller, the cutter that cuts the first medium;

a supplying unit that retains and supplies a second medium serving as the medium, the second medium having a single strip shape;

a conveyance unit that conveys the medium in the printer unit, the conveyance unit being placed on a downstream side of the transfer portion in a conveying direction of the medium and on an upstream side of the fixing portion; and a detector that detects a slack degree of the medium between the transfer portion and the fixing portion in the conveying direction, and outputs a signal in accordance with the slack degree, the conveyance unit comprises:

a conveyance unit main body that conveys the medium by moving a mount surface for the medium in a state where the mount surface faces an upper side; and an intake unit that performs an air intake action for tightly fitting the medium to the mount surface, the first control unit is capable of selecting a conveyance mode of the medium by the conveyance unit from a first mode to convey the first medium extended between the feed roller and the take-up roller, a second mode to convey the second medium supplied from the supplying unit, and a third mode to convey the second medium created by cutting the first medium which is fed from the feed roller by the cutter, passing speed at which the medium passes through a pass-through portion provided in the fixing portion is variable, when the first control unit selects the first mode, the second control unit controls the passing speed in accordance with an output signal from the detector in order to adjust the slack degree within a preliminarily set range, the supplying unit comprises a tray on which the second medium is mounted, and successively takes out the second medium on the tray from an end of the tray on a side closer to the printer unit and delivers the second medium toward an interior of the printer unit, and an end of the tray placed on the opposite side of the printer unit is placed at the same position as or on the upper side of the end of the tray on the side closer to the printer unit in an up and down direction.

8. An electrographic type label printer, comprising:

a printer unit that transfers a toner image to a medium and prints an image to the medium;

a medium supply unit that supplies the medium to the printer unit;

a first control unit that controls the medium supply unit; and a second control unit that controls the printer unit, wherein the printer unit comprises:

a transfer portion that transfers the toner image to the medium; and a fixing portion that fixes the toner image transferred to the medium, the medium supply unit comprises:

a feed roller that feeds a first medium serving as the medium, the first medium having a roll shape:

a take-up roller that takes up a part of the first medium where the image is printed;

a cutter arranged between the feed roller and the take-up roller, the cutter that cuts the first medium;

a supplying unit that retains and supplies a second medium serving as the medium, the second medium having a single strip shape;

a conveyance unit that conveys the medium in the printer unit, the conveyance unit being placed on a downstream side of the transfer portion in a conveying direction of the medium and on an upstream side of the fixing portion; and a detector that detects a slack degree of the medium between the transfer portion and the fixing portion in the conveying direction, and outputs a signal in accordance with the slack degree, the conveyance unit comprises:

a conveyance unit main body that conveys the medium by moving a mount surface for the medium in a state where the mount surface faces an upper side; and an intake unit that performs an air intake action for tightly fitting the ma ium to the mount surface, the first control unit is capable of selecting a conveyance mode of the medium by the conveyance unit from a first mode to convey the first medium extended between the feed roller and the take-up roller, a second mode to convey the second medium supplied from the supplying unit, and a third mode to convey the second medium created by cutting the first medium which is fed from the feed roller by the cutter, passing speed at which the medium passes through a pass-through portion provided in the fixing portion is variable, when the first control unit selects the first mode, the second control unit controls the passing speed in accordance with an output signal from the detector in order to adjust the slack degree within a preliminarily set range, length along the conveying direction of the second medium created by cutting the first medium by the cutter in the third mode is variable, and when the length along the conveying direction of the second medium created upon selecting the third mode by the first control unit is not less than a distance between the pass-through portion for the medium provided in the transfer portion and the pass-through portion for the medium provided in the fixing portion, the second control unit controls passing speed at which the second medium passes through the pass-through portion provided in the fixing portion in accordance with the output signal from the detector in order to adjust the slack degree within a preliminarily set range.

* * * * *